US006496796B1

(12) United States Patent
Tasaki et al.

(10) Patent No.: US 6,496,796 B1
(45) Date of Patent: Dec. 17, 2002

(54) VOICE CODING APPARATUS AND VOICE DECODING APPARATUS

(75) Inventors: Hirohisa Tasaki, Tokyo (JP); Tadashi Yamaura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 189 days.

(21) Appl. No.: 09/620,564

(22) Filed: Jul. 20, 2000

(30) Foreign Application Priority Data

Sep. 7, 1999 (JP) ..... 11-252863

(51) Int. Cl.[7] ..... G10L 19/04
(52) U.S. Cl. ..... 704/219; 704/221
(58) Field of Search ..... 704/219, 221

(56) References Cited

U.S. PATENT DOCUMENTS

| | | | | | |
|---|---|---|---|---|---|
| 4,561,102 | A | * | 12/1985 | Prezas | 704/207 |
| 4,991,215 | A | * | 2/1991 | Taguchi | 704/216 |
| 5,749,065 | A | * | 5/1998 | Nishiguchi et al. | 704/200.1 |
| 5,774,838 | A | * | 6/1998 | Miseki et al. | 704/207 |
| 5,825,311 | A | * | 10/1998 | Kataoka et al. | 341/51 |
| 5,878,388 | A | * | 3/1999 | Nishiguchi et al. | 704/208 |
| 5,960,388 | A | * | 9/1999 | Nishiguchi et al. | 704/208 |
| 6,018,707 | A | * | 1/2000 | Nishiguchi et al. | 704/219 |
| 6,330,534 | B1 | * | 12/2001 | Yasunaga et al. | 704/220 |
| 6,330,535 | B1 | * | 12/2001 | Yasunaga et al. | 704/220 |
| 6,345,247 | B1 | * | 2/2002 | Yasunaga et al. | 704/219 |

OTHER PUBLICATIONS

Akitoshi Kataoka, et al., "Basic Algorithm of Conjugate–Structure Algebraic CELP (CS–ACELP) Speech Coder," NTT R&D, vol. 45, (Apr. 1996), pp. 325–331.

Tadashi Amada, et al., "CELP Speech Coding Based On An Adaptive Pulse Position Codebook," 1999 IEEE International Conference on Acoustics, Speech, and Signal Processing, vol. I of VI Speech Processing I, (Mar.. 15–19, 1999), pp. 13–16.

* cited by examiner

*Primary Examiner*—Vijay B. Chawan
*Assistant Examiner*—Michael N. Opsasnick
(74) *Attorney, Agent, or Firm*—Oblon, Spivak, McClelland, Maier & Neustadt, P.C.

(57) ABSTRACT

Drive sound source coding means, decoding means has a plurality of algebraic sound source coding means, decoding means having sound source position tables different in distribution lean of sound source position candidates in a frame, each algebraic sound source coding means, decoding means for referencing spectrum envelope information and coding the sound source of an input voice based on a sound source position selected from among the sound source position candidates in the sound source position table and a polarity and selection means for selecting the algebraic sound source coding means, decoding means with the smallest coding distortion from among the plurality of algebraic sound source coding means, decoding means and outputting code representing the drive sound source position output by the selected algebraic sound source coding means, and polarity.

18 Claims, 11 Drawing Sheets

FIG. 3A

FIRST SOUND SOURCE POSITION TABLE

| SOUND SOURCE NO. | SOUND SOURCE POSITION CANDIDATES |
|---|---|
| 1 | 0, 10, 20, 30, 40, 50, 60, 70 |
| 2 | 2, 12, 22, 32, 42, 52, 62, 72 |
| 3 | 4, 14, 24, 34, 44, 54, 64, 74 |
| 4 | 6, 16, 26, 36, 46, 56, 66, 76<br>8, 18, 28, 38, 48, 58, 68, 78 |

FIG. 3B

SECOND SOUND SOURCE POSITION TABLE

| SOUND SOURCE NO. | SOUND SOURCE POSITION CANDIDATES |
|---|---|
| 1 | 0, 5, 10, 15, 20, 25, 30, 35 |
| 2 | 1, 6, 11, 16, 21, 26, 31, 36 |
| 3 | 2, 7, 12, 17, 22, 27, 32, 37 |
| 4 | 3, 8, 13, 18, 23, 28, 33, 38<br>4, 9, 14, 19, 24, 29, 34, 39 |

FIG. 5A

FIRST SOUND SOURCE POSITION TABLE

| SOUND SOURCE NO. | SOUND SOURCE POSITION CANDIDATES |
|---|---|
| 1 | 0, 10, 20, 30, 40, 50, 60, 70 |
| 2 | 2, 12, 22, 32, 42, 52, 62, 72 |
| 3 | 4, 14, 24, 34, 44, 54, 64, 74 |
| 4 | 6, 16, 26, 36, 46, 56, 66, 76<br>8, 18, 28, 38, 48, 58, 68, 78 |

FIG. 5B

SECOND SOUND SOURCE POSITION TABLE

| SOUND SOURCE NO. | SOUND SOURCE POSITION CANDIDATES |
|---|---|
| 1 | 40, 45, 50, 55, 60, 65, 70, 75 |
| 2 | 41, 46, 51, 56, 61, 66, 71, 76 |
| 3 | 42, 47, 52, 57, 62, 67, 72, 77 |
| 4 | 43, 48, 53, 58, 63, 68, 73, 78<br>44, 49, 54, 59, 64, 69, 74, 79 |

SECOND SOUND SOURCE POSITION TABLE

| SOUND SOURCE NO. | SOUND SOURCE POSITION CANDIDATES |
|---|---|
| 1 | 0 |
| 2 | 2, 12, 22, 32, 42, 52, 62, 72 |
| 3 | 4, 14, 24, 34, 44, 54, 64, 74 |
| 4 | 6, 16, 26, 36, 46, 56, 66, 76 |
| 5 | 8, 18, 28, 38, 48, 58, 68, 78 |

SOUND SOURCE POSITION TABLE

| SOUND SOURCE NO. | SOUND SOURCE POSITION CANDIDATES |
|---|---|
| 1 | 0, 5, 10, 15, 20, 25, 30, 35 |
| 2 | 1, 6, 11, 16, 21, 26, 31, 36 |
| 3 | 2, 7, 12, 17, 22, 27, 32, 37 |
| 4 | 3, 8, 13, 18, 23, 28, 33, 38<br>4, 9, 14, 19, 24, 29, 34, 39 |

VOICE CODING APPARATUS AND VOICE DECODING APPARATUS

BACKGROUND OF THE INVENTION

This invention relates to a voice coding apparatus for compressing a digital sound signal to a smaller information amount and a voice decoding apparatus for decoding voice code generated by the voice coding apparatus, etc., to reproduce the digital sound signal.

Most voice coding apparatus and voice decoding apparatus in related arts separate input voice into spectrum envelope information and a sound source and code them in frame units to generate voice code, then decode the voice code to combine the spectrum envelope information and the sound source through a combining filter, thereby providing decode voice.

A voice coding apparatus and a voice decoding apparatus using a code-excited linear prediction (CELP) technique are available as the most representative voice coding apparatus and voice decoding apparatus.

FIG. 15 shows the general configuration of a CELP base voice coding apparatus. In the figure, numeral 1 denotes input voice, numeral 2 denotes linear prediction analysis means, numeral 3 denotes linear prediction coefficient coding means, numeral 4 denotes adaptive sound source coding means, numeral 5 denotes drive sound source coding means, numeral 6 denotes gain coding means, numeral 7 denotes multiplexing means, and numeral 8 denotes voice code.

FIG. 16 shows the general configuration of a CELP base voice decoding apparatus. In the figure, numeral 9 denotes demultiplexing means, numeral 10 denotes linear prediction coefficient decoding means, numeral 11 denotes adaptive sound source decoding means, numeral 12 denotes drive sound source decoding means, numeral 13 denotes gain decoding means, numeral 14 denotes a combining filter, and numeral 15 denotes output voice.

The voice coding apparatus and the voice decoding apparatus in the related art perform processing in frame units with about 5 to 50 ms as a frame. The operation of the voice coding apparatus and the voice decoding apparatus in the related art is as follows:

First, in the voice coding apparatus, the input voice 1 is input to the linear prediction analysis means 2 and the adaptive sound source coding means 4. The linear prediction analysis means 2 analyzes the input voice 1 and extracts a linear prediction coefficient of voice spectrum envelope information. The linear prediction coefficient coding means 3 codes the linear prediction coefficient and outputs the code to the multiplexing means 7 and also outputs the coded linear prediction coefficient for coding a sound source.

The adaptive sound source coding means 4, in which past sound sources are previously stored as an adaptive sound source code book, prepares time-series vectors periodically repeating the past sound sources corresponding to the adaptive sound source codes. Next, the adaptive sound source coding means 4 multiplies each time-series vector by an appropriate gain and allows the result to pass through a combining filter using the coded linear prediction coefficient for providing a tentative composite tone. It examines the distance between the tentative composite tone and the input voice 1, selects an adaptive sound source code to minimize the distance, and outputs the time-series vector corresponding to the selected adaptive sound source code as the adaptive sound source. The adaptive sound source coding means 4 also outputs the input voice 1 or a signal provided by subtracting the composite tone based on the adaptive sound source from the input voice 1 to the drive sound source coding means 5 at the following stage.

The drive sound source coding means 5 first reads time-series vectors sequentially from a drive sound source code book stored in the drive sound source coding means 5 corresponding to drive sound source codes. Next, the drive sound source coding means 5 multiplies each time-series vector and the adaptive sound source by an appropriate gain, adds the results, and allows the addition result to pass through a combining filter using the coded linear prediction coefficient for providing a tentative composite tone. It uses the input voice 1 or the signal provided by subtracting the composite tone based on the adaptive sound source from the input voice 1 as a signal to be coded, examines the distance between the signal to be coded and the tentative composite tone, selects a drive sound source code to minimize the distance, and outputs the time-series vector corresponding to the selected drive sound source code as the drive sound source.

The gain coding means 6 first reads gain vectors sequentially from a gain code book stored in the gain coding means 6 corresponding to gain codes. The gain coding means 6 multiplies the adaptive sound source and the drive sound source by each element of each gain vector, adds the results, and allows the addition result to pass through a combining filter using the coded linear prediction coefficient for providing a tentative composite tone. It examines the distance between the tentative composite tone and the input voice 1 and selects a gain code to minimize the distance.

Last, the adaptive sound source coding means 4 multiplies the adaptive sound source and the drive sound source by each element of the gain vector corresponding to the selected gain code and adds the results, thereby preparing a sound source and updating the adaptive sound source code book.

The multiplexing means 7 multiplexes the linear prediction coefficient code, the adaptive sound source code, the drive sound source code, and the gain code and outputs a provided voice code 8.

In the voice decoding apparatus, the demultiplexing means 9 demultiplexes the voice code 8 into the linear prediction coefficient code, the adaptive sound source code, the drive sound source code, and the gain code.

The linear prediction coefficient decoding means 10 decodes the linear prediction coefficient from the linear prediction coefficient code and sets the linear prediction coefficient as a coefficient of the combining filter 14.

Next, the adaptive sound source decoding means 11, in which past sound sources are previously stored as an adaptive sound source code book, outputs time-series vectors periodically repeating the past sound sources corresponding to the adaptive sound source codes. The drive sound source decoding means 12 outputs the time-series vector corresponding to the drive sound source code. The gain decoding means 13 outputs the gain vector corresponding to the gain code. The two time-series vectors are multiplied by each element of the gain vector and the results are added for preparing a sound source. This sound source is made to pass through the combining filter 14 to prepare an output voice 15.

Last, the adaptive sound source decoding means 11 uses the prepared sound source to update the adaptive sound source code book.

Next, related arts intended for improving the CELP base voice coding apparatus and voice decoding apparatus will be discussed.

Document 1

KATAOKA Akitoshi, HAYASHI Shinji, MORITANI Takehiro, KURIHARA Shoko, MANO Kazunori "CS-ACELP no kihon algorithm" NTT R&D, Vol. 45, pp. 325–330 (April 1996) discloses CELP base voice coding apparatus and voice decoding apparatus adopting a pulse sound source for coding a drive sound source for the main purpose of reducing the operation amount and the memory amount. In the configuration in the related art, a drive sound source is represented only by several-pulse position information and polarity information. Such a sound source, which is called an algebraic sound source, has a good coding characteristic for its simple structure and has been adopted in most recent standards.

FIG. 17 is a table listing position candidates of pulse sound sources used in Document 1. In Document 1, the sound source coding frame length is 40 samples and each drive sound source consists of four pulses. The position candidates of each of the pulse sound sources with sound source numbers 1 to 3 are limited to eight positions as shown in FIG. 17, and each pulse position can be coded in three bits. The position candidates of the pulse sound source with sound source number 4 are limited to 16 positions, and the pulse position can be coded in four bits. The position candidates of the pulse sound sources are limited, whereby the number of code bits and the number of combinations can be reduced for reducing the operation amount while degradation of the coding characteristic is suppressed.

The configurations for improving the quality of the algebraic sound source are disclosed in the Unexamined Japanese Patent Application Publication No. Hei 10-232696 and Document 2

Tadashi Amada, Kimio Miseki and Masami Akamine "CELP SPEECH CODING BASED ON AN ADAPTIVE PULSE POSITION CODEBOOK" 1999 IEEE International Conference on Acoustics, Speech, and Signal Processing, vol. I, pp. 13–16 (March 1999), and Document 3

TUCHIYA, AMADA, MISEKI "Tekiou pulse ichi ACELP onsei fugouka no kaizen" Nihon Onkyou Gakkai 1999 shunki kenkyuu happoukai kouen ronbunshuu I, pp. 213–214.

In the Unexamined Japanese Patent Application Publication No. Hei 10-232696, a plurality of fixed waveforms are provided and are placed at algebraically coded sound source positions, thereby preparing drive sound sources. A plurality of drive sound source preparation means (noise code books) are provided and one of them is selected for use based on coding distortion or the voice analysis result. As the plurality of drive sound source preparation means, the case where they differ in the number of fixed waveforms and at least one for preparing a random number sequence and a pulse string different from the algebraic sound source are disclosed. According to the configurations, a high-quality output voice can be provided.

Document 2 indicates that the position candidates of pulse sound sources are set adaptively for each frame so that they collect where amplitude envelopes of adaptive sound sources are large in size, whereby the coding characteristic can be improved.

Document 3 corresponds to an improvement in Document 2. When a pitch filter is contained in a drive sound source (in Document 3, ACELP sound source) preparation section, there is a tendency to easily select the sound source position in the first one-pitch period section, and the position candidates of pulse sound sources are set adaptively for each frame based on the size of the amplitude envelope of the adaptive sound source undergoing pitch inverse filtering at the time.

The described related arts involve the following problems:

In the voice coding apparatus and the voice decoding apparatus disclosed in Document 1, a fixed number of position candidates for each sound source number exist for each of divisions into which a frame is equally divided, namely, are distributed equally within the frame. To make a low bit rate with the configuration intact, the number of bits must be decreased or the position candidates for each sound source number must be thinned out at equal intervals; in this case, however, abrupt characteristic degradation is incurred.

To help resolve the problem, Documents 1 and 2 disclose each an adaptive thinning-out method for suppressing the characteristic degradation. However, when the periodicity of input voice is disordered or changes, adaptive thinning out results in large characteristic degradation; this is a problem. The adaptive thinning-out processing also affects the drive sound source when an error occurs in the adaptive sound source because of a code transmission error on a communication channel; this is also a problem.

In Document 3, when a pitch filter is contained in the drive sound source preparation section, the sound source position candidates are concentrated on the first one-pitch period section, whereby an average characteristic improvement is accomplished. However, the latter half of a frame may be important in the voice rising section which is the most important in the hearing sense or the like; the latter half of the frame cannot well be represented, characteristic degradation is caused, and quality degradation is caused in the hearing impression.

In the Unexamined Japanese Patent Application Publication No. Hei 10-232696, a plurality of drive sound source preparation means (noise code books) are provided for intending improvement in the characteristic, but the position candidates themselves where fixed sound sources are placed are not novel (the same as Document 1). As in Document 1, to make a low bit rate, a problem of incurring abrupt characteristic degradation is involved.

In both Document 1 and the Unexamined Japanese Patent Application Publication No. Hei 10-232696, if the sound source positions provided as the coding result concentrate on the back of the frame, a low-amplitude section of drive sound source is produced in the first half of the frame and a discontinuous sense of amplitude is heard in a section of small amplitude of adaptive sound source such as a frictional sound; this is a problem. FIG. 18 shows an example of output voice 15 involving the discontinuous sense. Since the drive sound source top position in a frame is at a distance from the top of the frame, a low-amplitude section occurs in the vicinity of the frame top. In the Unexamined Japanese Patent Application Publication No. Hei 10-232696, a mode of coding a sound source in a random number sequence, etc., can also be provided for resolving the problem. However, a problem of losing the feature of an algebraic sound source lessening the memory amount and the operation amount is involved.

SUMMARY OF THE INVENTION

It is therefore an object of the invention to provide a voice coding apparatus and a voice decoding apparatus good in quality although a low bit rate is applied.

According to the invention, there is provided a voice coding apparatus comprising drive sound source coding means, gain coding means, and spectrum envelope information coding means, wherein an input voice is separated into spectrum envelope information and a sound source and the spectrum envelope information and the sound source are coded for each predetermined-length section called a frame, characterized in that the spectrum envelope information coding means codes the spectrum envelope information of the input voice, that the drive sound source coding means comprises a plurality of algebraic sound source coding means having sound source position tables different in distribution lean of sound source position candidates in a frame, each algebraic sound source coding means for referencing the spectrum envelope information and coding the sound source of the input voice based on a sound source position selected from among the sound source position candidates in the sound source position table and a polarity and selection means for selecting the algebraic sound source coding means with the smallest coding distortion from among the plurality of algebraic sound source coding means and outputting selection information, code representing the drive sound source position output by the selected algebraic sound source coding means, and polarity, and that the gain coding means selects gain code based on the drive sound source and the spectrum envelope information.

In the voice coding apparatus according to the invention, at least one of the plurality of algebraic sound source coding means comprises the sound source position table having the sound source position candidates distributed leaning to the forward part of the current frame.

In the voice coding apparatus according to the invention, at least one of the plurality of algebraic sound source coding means comprises the sound source position table having the sound source position candidates distributed leaning to the backward part of the current frame.

According to the invention, there is provided a voice coding apparatus comprising drive sound source coding means, gain coding means, and spectrum envelope information coding means, wherein an input voice is separated into spectrum envelope information and a sound source and the spectrum envelope information and the sound source are coded for each predetermined-length section called a frame, characterized in that the spectrum envelope information coding means codes the spectrum envelope information of the input voice, that the drive sound source coding means comprises a plurality of algebraic sound source coding means for coding the sound source of the input voice based on a sound source position selected from among sound source position candidates and a polarity and selection means for selecting one from among the plurality of algebraic sound source coding means and outputting selection information, code representing the sound source position output by the selected algebraic sound source coding means, and a polarity, wherein at least one of the plurality of algebraic sound source coding means selects one or more sound source positions from within the range of a small number of samples starting at the frame top, and that the gain coding means selects gain code based on the drive sound source and the spectrum envelope information.

According to the invention, there is provided a voice coding apparatus comprising drive sound source coding means, gain coding means, and spectrum envelope information coding means, wherein an input voice is separated into spectrum envelope information and a sound source and the spectrum envelope information and the sound source are coded for each predetermined-length section called a frame, characterized in that the spectrum envelope information coding means codes the spectrum envelope information of the input voice, that the drive sound source coding means comprises a plurality of algebraic sound source coding means for coding the sound source of the input voice based on a sound source position selected from among sound source position candidates and a polarity and selection means for selecting one from among the plurality of algebraic sound source coding means and outputting selection information, code representing the sound source position output by the selected algebraic sound source coding means, and a polarity, wherein the plurality of algebraic sound source coding means differ in sound source position candidates and the position candidates for one sound source in at least one sound source position candidate are limited within the range of a small number of samples starting at the frame top, and that the gain coding means selects gain code based on the drive sound source and the spectrum envelope information.

In the voice coding apparatus according to the invention, the selection means selects the algebraic sound source coding means based on a predetermined parameter representing an input voice feature.

In the voice coding apparatus according to the invention, as the predetermined parameter in the selection means, the spectrum envelope information output by the voice coding apparatus provided before the operation of the selection means is used and the selection means outputs only the code representing the sound source position and the polarity.

According to the invention, there is provided a voice coding apparatus comprising drive sound source coding means, gain coding means, and spectrum envelope information coding means, wherein an input voice is separated into spectrum envelope information and a sound source and the spectrum envelope information and the sound source are coded for each predetermined-length section called a frame, characterized in that the spectrum envelope information coding means codes the spectrum envelope information of the input voice, that the drive sound source coding means is algebraic sound source coding means for coding the sound source based on a sound source position selected from among sound source position candidates and a polarity and makes a search with a limitation imposed on sound source position combinations only if a predetermined parameter representing an input voice feature satisfies a predetermined condition, and that the gain coding means selects gain code based on the drive sound source and the spectrum envelope information.

In the voice coding apparatus according to the invention, the limitation imposed on the sound source position combinations is that one or more sound source positions should exist in the range of a small number of samples starting at the frame top.

In the voice coding apparatus according to the invention, the limitation imposed on the sound source position combinations is that when a frame is equally divided into as many divisions as the number of pulses, one pulse should always be contained in each division.

In the voice coding apparatus according to the invention, the range of a small number of samples is only the frame top.

According to the invention, there is provided a voice decoding apparatus comprising drive sound source decoding means, gain decoding means, spectrum envelope information decoding means, and a combining filter, wherein voice code separated into spectrum envelope information and a sound source which are coded is decoded for each predetermined-length section called a frame, characterized in that the spectrum envelope information decoding means decodes the spectrum envelope information from the voice code and sets a coefficient of the combining filter, that the drive sound source decoding means comprises a plurality of algebraic sound source decoding means having sound source position tables different in distribution lean of sound source position candidates in a frame, each algebraic sound source coding means for selecting a sound source position among sound source position candidates based on code representing a sound source position in the voice code and decoding the sound source using the sound source position and a polarity, and switch means for outputting the code representing the sound source position in the voice code and the polarity to one of the plurality of algebraic sound source decoding means, that the gain decoding means outputs a gain vector corresponding to gain code and multiplies the sound source by the gain vector, and that the combining filter uses the coefficient set by the spectrum envelope information decoding means to prepare an output voice from the sound source multiplied by the gain vector.

In the voice decoding apparatus according to the invention, at least one of the plurality of sound source position candidates that the plurality of algebraic sound source decoding means have is distributed leaning to the forward part of the current frame.

In the voice decoding apparatus according to the invention, at least one of the plurality of sound source position candidates that the plurality of algebraic sound source decoding means have is distributed leaning to the backward part of the current frame.

According to the invention, there is provided a voice decoding apparatus comprising drive sound source decoding means, gain decoding means, spectrum envelope information decoding means, and a combining filter, wherein voice code separated into spectrum envelope information and a sound source which are coded is decoded for each predetermined-length section called a frame, characterized in that the spectrum envelope information decoding means decodes the spectrum envelope information from the voice code and sets a coefficient of the combining filter, that the drive sound source decoding means comprises a plurality of algebraic sound source decoding means each for selecting a sound source position among sound source position candidates based on code representing a sound source position in the voice code and decoding the sound source using the sound source position and a polarity, and switch means for outputting the code representing the sound source position in the voice code and the polarity to one of the plurality of algebraic sound source decoding means, wherein the plurality of algebraic sound source decoding means differ in sound source position candidates and the position candidates for one sound source in at least one sound source position candidate are limited within a predetermined range of a small number of samples starting at the frame top, that the gain decoding means outputs a gain vector corresponding to gain code and multiplies the sound source by the gain vector, and that the combining filter uses the coefficient set by the spectrum envelope information decoding means to prepare an output voice from the sound source multiplied by the gain vector.

In the voice decoding apparatus according to the invention, the predetermined range of a small number of samples is only the frame top.

In the voice decoding apparatus according to the invention, the received voice code contains selection information and the switch means outputs the code representing the sound source position in the voice code and the polarity to one of the plurality of algebraic sound source decoding means based on the selection information.

In the voice decoding apparatus according to the invention, the switch means finds selection information based on the received voice code or the decoding result and outputs the code representing the sound source position in the voice code and the polarity to one of the plurality of algebraic sound source decoding means based on the selection information.

BRIEF DESCRIPTION OF THE DRAWINGS

In the accompanying drawings:

FIGS. 3A and 3B are schematic representations of sound source position tables used in the first embodiment of the invention;

FIGS. 5A and 5B are schematic representations of sound source position tables used in a second embodiment of the invention;

DETAILED DESCRIPTION OF THE PREFERRED EMBODIMENTS

Referring now to the accompanying drawings, there are shown preferred embodiments of the invention.

(First Embodiment)

Figure 1:
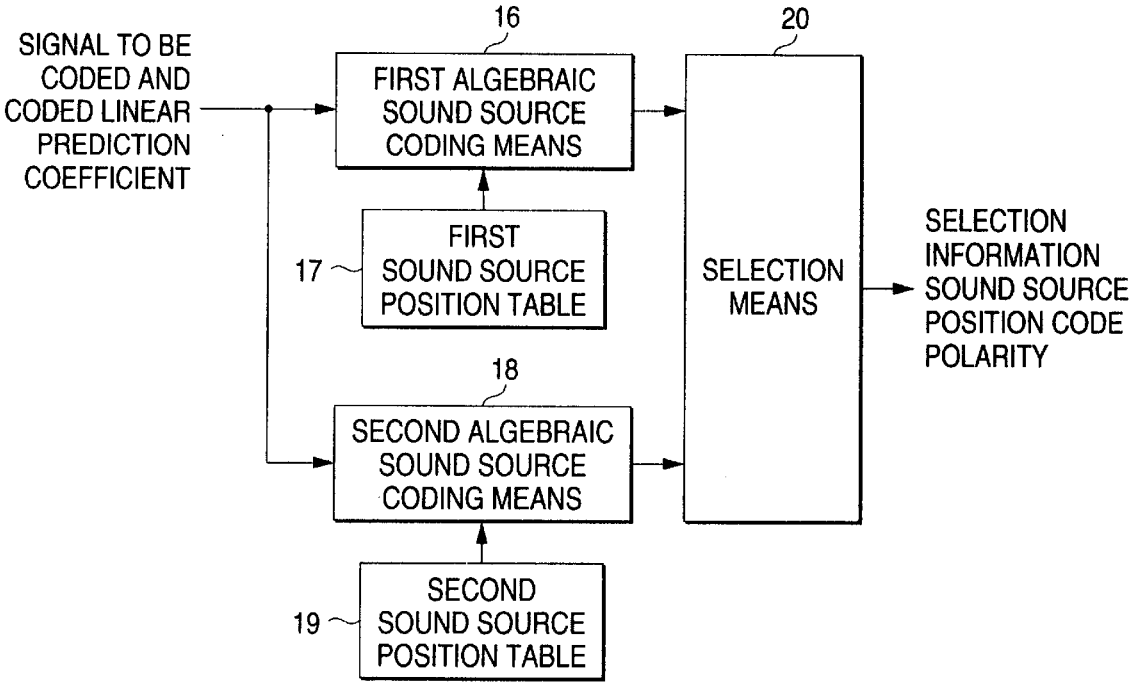
FIG. 1 is a block diagram of drive sound source coding means in a voice coding apparatus according to a first embodiment of the invention.
Figure 15:
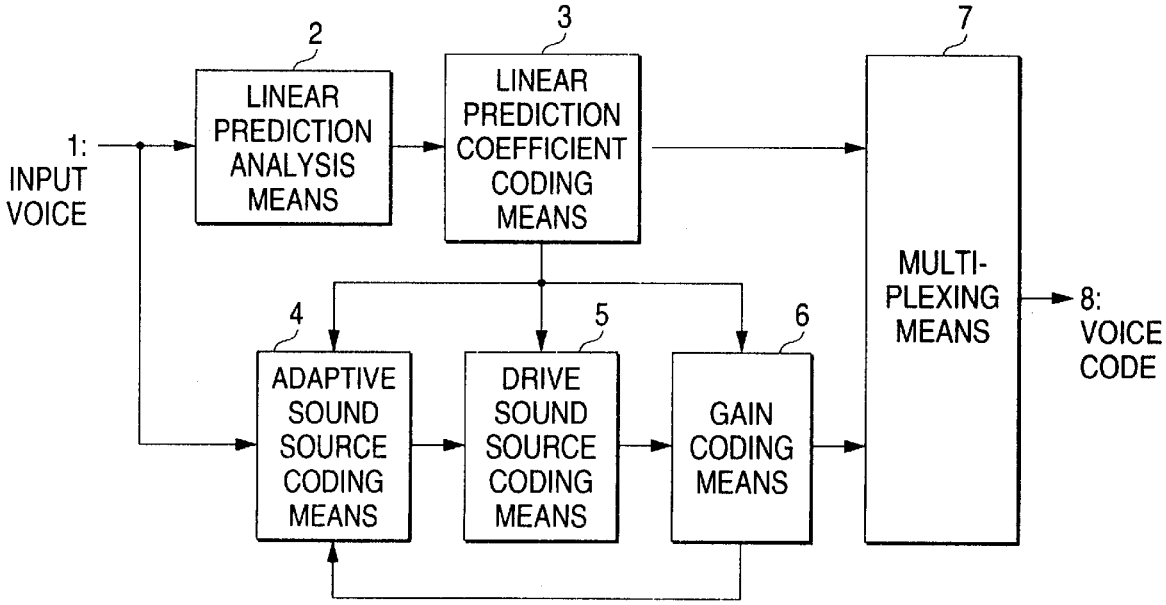
FIG. 15 is a general block diagram of a CELP base voice coding apparatus in a related art.

FIG. 1 shows the configuration of drive sound source coding means 5 in a voice coding apparatus according to a first embodiment of the invention. The general configuration of the voice coding apparatus is similar to that previously described with reference to FIG. 15. In FIG. 1, numeral 16 denotes first algebraic sound source coding means, numeral 17 denotes a first sound source position table, numeral 18 denotes second algebraic sound source coding means, numeral 19 denotes a second sound source position table, and numeral 20 denotes selection means.

The first sound source position table 17 has an equal position distribution in a frame and the second sound source position table 19 has a position distribution in the first half of the frame.

Figure 2:
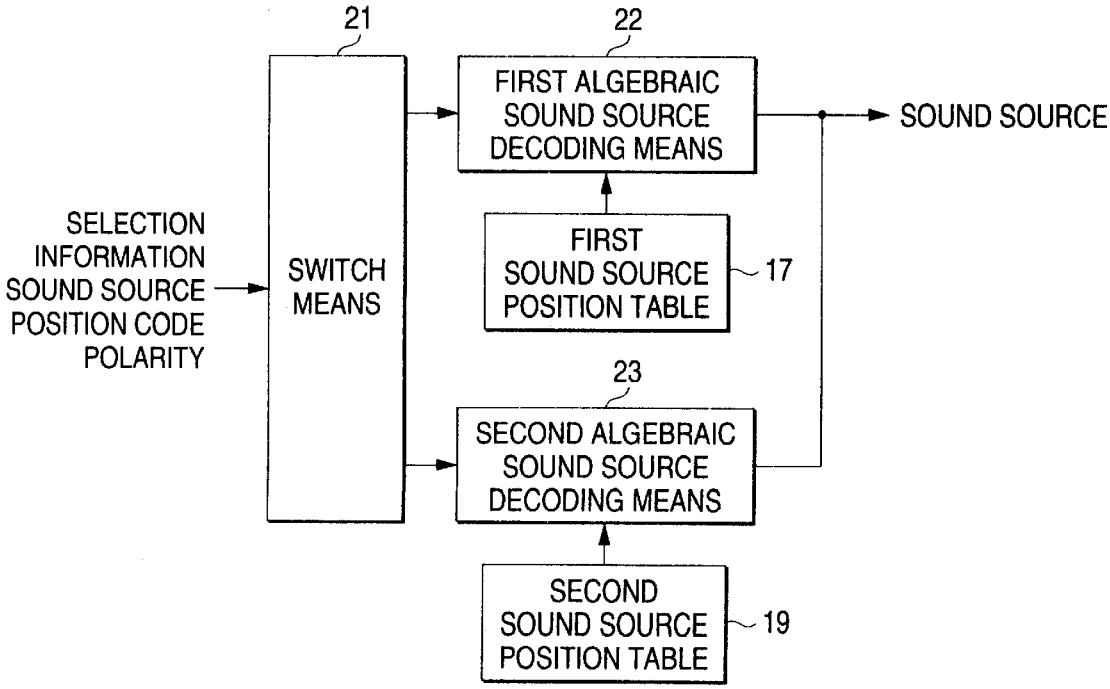
FIG. 2 is a block diagram of drive sound source decoding means in a voice decoding apparatus according to the first embodiment of the invention.
Figure 16:
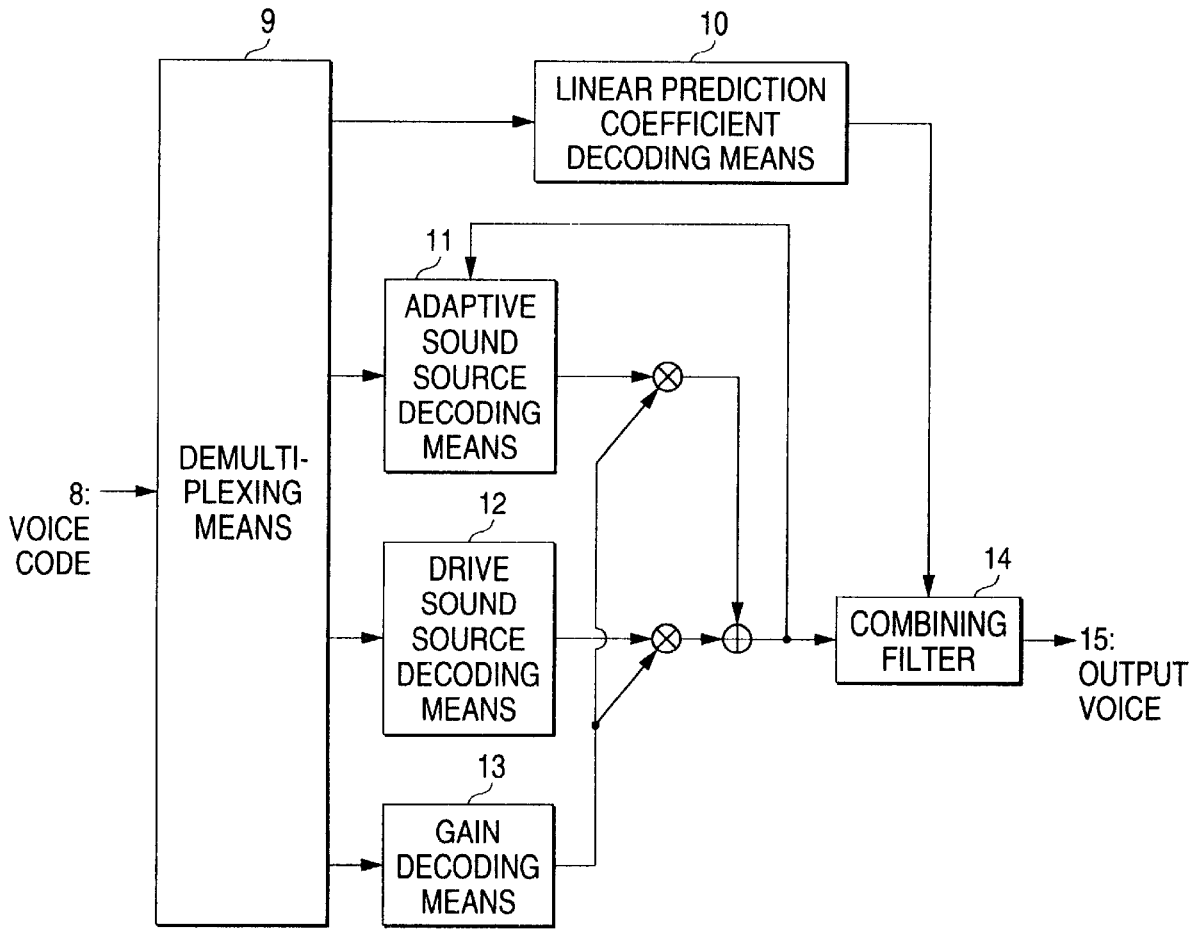
FIG. 16 is a general block diagram of a CELP base voice decoding apparatus in the related art.

FIG. 2 shows the configuration of drive sound source decoding means 12 in a voice decoding apparatus according to the first embodiment of the invention. The general configuration of the voice decoding apparatus is similar to that previously described with reference to FIG. 16. In FIG. 2, numeral 21 denotes switch means, numeral 22 denotes first algebraic sound source decoding means, and numeral 23 denotes second algebraic sound source decoding means.

The operation will be discussed based on the accompanying drawings.

First, the voice coding apparatus will be discussed. A signal to be coded from adaptive sound source coding means 4 and a coded linear prediction coefficient from linear prediction analysis means 2 are input to the first algebraic sound source coding means 16 and the second algebraic sound source coding means 18.

The first algebraic sound source coding means 16 sequentially reads sound source position candidates stored in the first sound source position table 17, prepares a tentative composite tone when a pulse is set with an appropriate polarity at each position, calculates the distance to the signal to be coded, and makes a search for the sound source position and the polarity to minimize the distance. Then, the first algebraic sound source coding means 16 outputs the minimum distance, the sound source position code representing the sound source position at the time, and the polarity to the selection means 20.

The second algebraic sound source coding means 18 sequentially reads sound source position candidates stored in the second sound source position table 19, prepares a tentative composite tone when a pulse is set with an appropriate polarity at each position, calculates the distance to the signal to be coded, and makes a search for the sound source position and the polarity to minimize the distance. Then, the first algebraic sound source coding means 16 outputs the minimum distance, the sound source position code representing the sound source position at the time, and the polarity to the selection means 20.

The search operation in the two algebraic sound source coding means is performed in a similar manner to that in the drive sound source coding means described in Document 1 or the Unexamined Japanese Patent Application Publication No. Hei 10-232696. A pitch filter is introduced into the last stage of a drive sound source preparation section as shown in Document 3. That is, the pitch filter is applied to a signal with a pulse or a fixed sound source placed at each sound source position to provide a sound source and a tentative composite tone for it is prepared. The correlation between the tentative composite tones for each sound source position and the correlation between the tentative composite tone and the signal to be coded for each sound source position are calculated and the correlations are used to determine the polarity for each position and make a position search at high speed. Consequently, a plurality of sound source positions and polarities are provided. Each sound source position is converted into the code corresponding to the order in the sound source position table and is output as the final sound source position code.

FIGS. 3A and 3B show examples of sound source position tables used when the frame length of sound source coding is 80 points. Each table has four sound source position sets and the algebraic sound source coding means selects one sound source position out of each sound source position set. FIG. 3A shows an example of the first sound source position table 17 and FIG. 3B shows an example of the second sound source position table 19. The first sound source position table 17 provides double each of the sound source positions in the sound source position table in Document 1 shown in FIG. 17. This means that the sound source position candidate is set every other sample. In contrast, the second sound source position table 19 is the same as the sound source position table in Document 1 shown in FIG. 17. Consequently, only the positions in the first half of the sound source frame are set as the sound source position candidates. This means that the sound source position candidates are not set in the latter half of the sound source frame.

To use the sound source position tables shown in FIGS. 3A and 3B, in the first algebraic sound source coding means 16, four sound source positions can be selected equally in the whole frame although the positions are limited to those every other sample. Although the sound source positions can be selected only in the first half of the frame in the second algebraic sound source coding means 18, when the pitch period is 40 samples or less, the first-half section containing the first one-pitch period in the frame can be well represented by four position information pieces.

The selection means 20 compares the minimum distance output by the first algebraic sound source coding means 16 with the minimum distance output by the second algebraic sound source coding means 18, selects the algebraic sound source coding means outputting the smaller distance, and outputs the selection information and the sound source position code and the polarity output by the selected algebraic sound source coding means. That is, the drive sound source coding means 5 outputs the sound source position code and the polarity.

Figure 4:
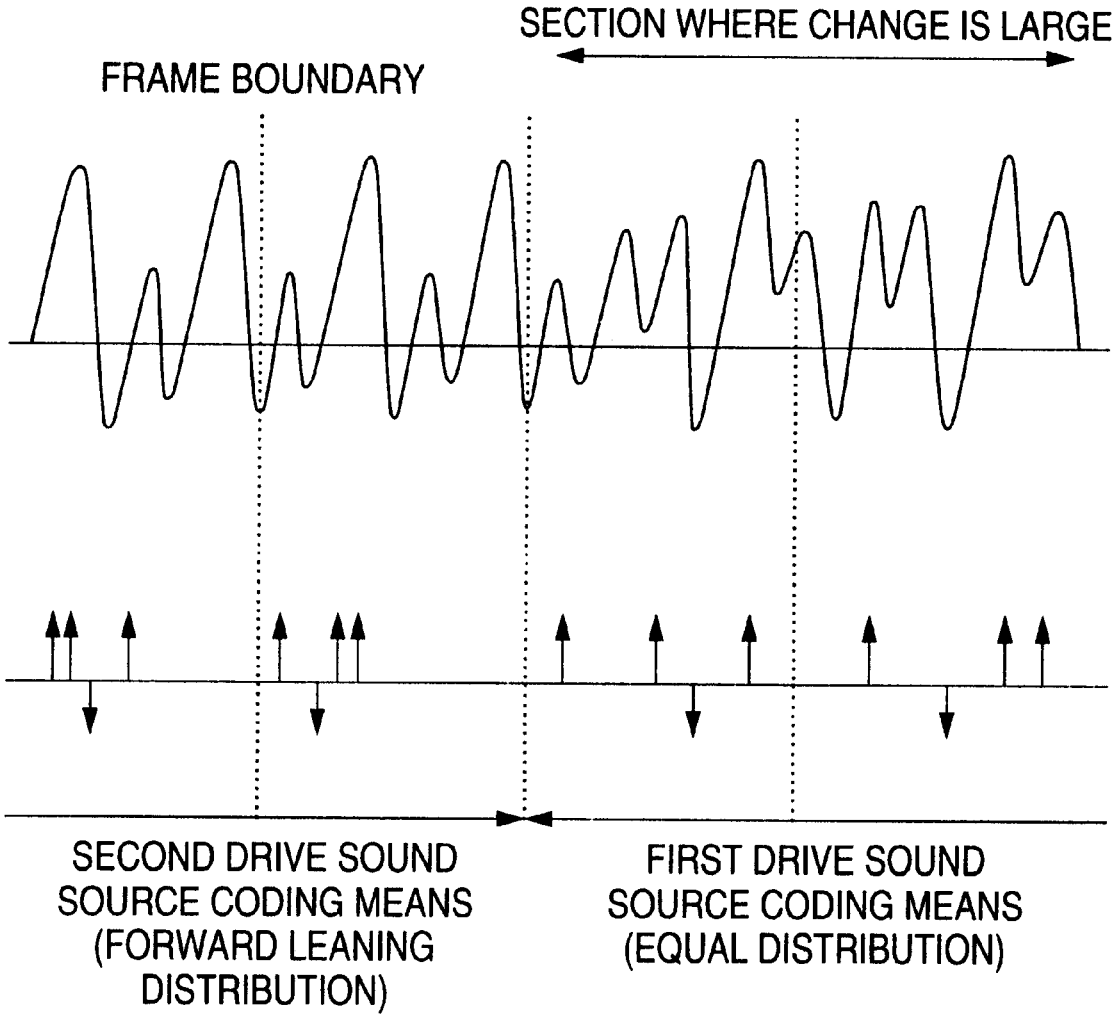
FIG. 4 is a schematic representation of output of drive sound source coding means according to the first embodiment of the invention.

FIG. 4 is a schematic representation to describe the selection result of the selection means 20. In the figure, the upper stage indicates the voice to be coded and the lower stage indicates the pulse position and the polarity provided as the coding result of the drive sound source coding means 5. If the voice to be coded is steady, coding distortion becomes smaller if the sound source positions are collected in the one-pitch period at the frame top as described in Document 1. Thus, the second algebraic sound source coding means using the sound source position candidates having a forward leaning distribution is selected. On the other hand, in a section where change in the voice to be coded is large, the first algebraic sound source coding means using the sound source position candidates having an equal distribution suitable for representing gradual waveform change in the frame is selected.

Next, the operation of the voice decoding apparatus is as follows: When the selection information, the sound source position code, and the polarity are input, the switch means 21 in the drive sound source decoding means 12 outputs the sound source position code and the polarity to either the first algebraic sound source decoding means 22 or the second algebraic sound source decoding means 23 according to the selection information.

The first algebraic sound source decoding means 22 reads the sound source position corresponding to the sound source position code from the first sound source position table 17, which is the same as the first sound source position table 17 of the first algebraic sound source coding means 16, applies a pitch filter to a signal with a pulse or a fixed sound source given the polarity placed at the sound source position to provide a sound source, and outputs the sound source. That is, to use the first sound source position table 17 shown in FIG. 3A, a pulse or a fixed sound source is placed at each of the three positions corresponding to the three sound source position codes and the sound source provided by applying the pitch filter is output.

The second algebraic sound source decoding means 23 reads the sound source position corresponding to the sound source position code from the second sound source position table 19, which is the same as the second sound source position table 19 of the second algebraic sound source coding means 18, applies a pitch filter to a signal with a pulse or a fixed sound source given the polarity placed at the sound source position to provide a sound source, and outputs the sound source. That is, to use the second sound source position table 19 shown in FIG. 3B, a pulse or a fixed sound source is placed at each of the four positions corresponding to the four sound source position codes and the sound source provided by applying the pitch filter is output.

Since the sound source position code and the polarity are input to either the first algebraic sound source decoding means 22 or the second algebraic sound source decoding means 23 through the switch means 21, the sound source output by the algebraic sound source decoding means to which the sound source position code and the polarity are input becomes the final output of the drive sound source decoding means 12.

In the embodiment, the pitch filter is introduced into the drive sound source preparation section; it can be introduced only in the drive sound source decoding means 12 or introduced in neither the drive sound source coding means 5 nor the drive sound source decoding means 12, of course.

The first sound source position table 17 and the second sound source position table 19 can also be connected to the first algebraic sound source coding means 16 through the switch means for eliminating the need for the second algebraic sound source coding means 18. Likewise, the first sound source position table 17 and the second sound source position table 19 can also be connected to the first algebraic sound source decoding means 22 through the switch means 20 for eliminating the need for the second algebraic sound source decoding means 23.

The following configuration is also possible: N−2 sound source position tables (where N is three or more) are added, N types of algebraic sound source coding are performed, the selection mean 20 selects the one to provide the smallest distance among them and outputs selection information, and the switch means 21 uses one of the N sound source position tables based on the selection information to perform algebraic sound source decoding.

Further, adaptive sound source position candidates to the pitch period can also be used for the second sound source position table 19 for intending characteristic improvement.

Any other spectrum parameter such as LSP may be used in place of the linear prediction coefficient.

In a section where the efficiency of an adaptive sound source is poor in a transient part, etc., such as a consonant part or voice rising section, it is also effective to eliminate the adaptive sound source coding means and the adaptive sound source decoding means and code only with a drive sound source and a gain. In this case, a mode of using an adaptive sound source and a mode of using no adaptive sound source are provided and either of them may be selected for use in response to the voice state. If the code information amount is sufficient, etc., it is also possible to eliminate the adaptive sound source coding means and the adaptive sound source decoding means and code only with a drive sound source and a gain.

According to the first embodiment, a plurality of algebraic sound source coding means using sound source position candidates different in distribution lean in a frame are provided and algebraic sound source coding means with the smallest coding distortion is selected, so that voice coding apparatus that can perform coding using a sound source position candidate fitted to an input voice and is good in quality although a low bit rate is applied can be provided.

According to the first embodiment, a plurality of algebraic sound source decoding means using sound source position candidates different in distribution lean in a frame are provided and based on the selection information, one of the algebraic sound source decoding means is used to decode the sound source, so that voice decoding apparatus that can perform decoding using an optimum sound source position candidate selected for an input voice and is good in quality although a low bit rate is applied can be provided.

Since fixed sound source position candidates are used, characteristic improvement can be accomplished while resistance to a code transmission error on a communication channel is maintained. Even to introduce adaptive sound source position candidates into a part, when algebraic sound source coding using the remaining fixed sound source position candidates is selected, the effect of a transmission error is largely forgotten and characteristic improvement can be accomplished while resistance to a code transmission error on a communication channel is maintained to some extent.

Further, at least one of the sound source position candidates is determined to have a distribution leaning to the forward part of the current frame, whereby the algebraic sound source coding means and the algebraic sound source decoding means using the sound source position candidates having the forward leaning distribution are selected in a comparatively steady vowel part, etc., for executing good coding and decoding (Document 3 describes that when a pitch filter is contained in a drive sound source preparation section, there is a tendency to easily select the sound source position in the first one-pitch period section). In a frame where good coding and decoding cannot be performed using the sound source position candidates having the forward leaning distribution, different algebraic sound source coding means and algebraic sound source decoding means are selected for executing coding and decoding without extreme degradation, so that voice coding apparatus and voice decoding apparatus which are good in quality although a low bit rate is applied can be provided.

As compared with the configuration in the related art wherein the sound source position candidates are provided equally in a frame, the algebraic sound source coding means using the sound source position candidates distributed leaning to the forward part of a frame accomplishes average characteristic improvement. Also as compared with the configuration in the related art wherein the sound source position candidates are concentrated on the one-pitch period section, another algebraic sound source coding means can suppress quality degradation in rising, etc., whereby particularly the hearing sense quality is improved.

(Second Embodiment)

FIGS. 5A and 5B show examples of sound source position tables used when the frame length of sound source coding is 80 points.

FIG. 5A shows an example of a first sound source position table 17 and FIG. 5B shows an example of a second sound source position table 19. The first sound source position table 17, like that in FIG. 3A, provides double each of the sound source positions in the sound source position table in Document 1 shown in FIG. 17. This means that the sound source position candidate is set every other sample. In contrast, the second sound source position table 19 is provided by adding 40 to the value of each position in the sound source position table in Document 1 shown in FIG. 17. Consequently, only the positions in the latter half of the sound source frame are set as the sound source position candidates. This means that the sound source position candidates are not set in the first half of the sound source frame.

Drive sound source coding means 5 and drive sound source decoding means 12 using the second sound source position tables have the same configurations as and operate in a similar manner to that of those previously described with reference to FIGS. 1 and 2 and therefore will not be discussed again.

To use the sound source position tables shown in FIGS. 5A and 5B, in first algebraic sound source coding means 16, four sound source positions can be selected equally in the whole frame although the positions are limited to those every other sample. Although the sound source positions can be selected only in the latter half of the frame in second algebraic sound source coding means 18, when important information concentrates only on the latter half in a voice rising section, etc., the second algebraic sound source coding means 18 can provide good coding result.

Figure 6:
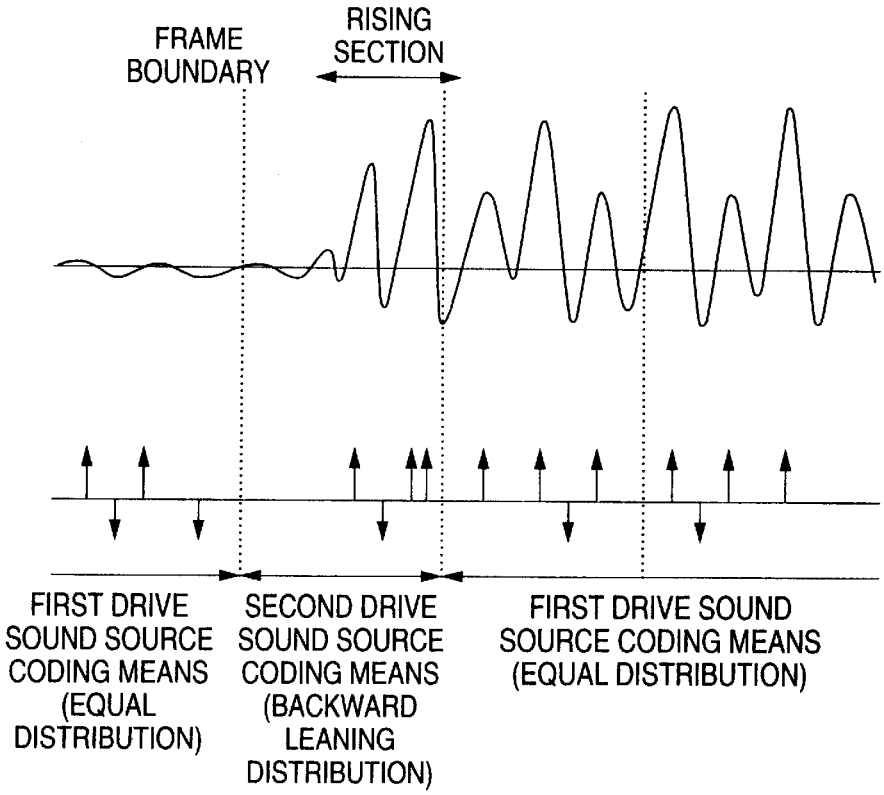
FIG. 6 is a schematic representation of output of drive sound source coding means according to the second embodiment of the invention.

FIG. 6 is a schematic representation to describe the selection result of selection means 20. In the figure, the upper stage indicates the voice to be coded and the lower stage indicates the pulse position and the polarity provided as the coding result of the drive sound source coding means 5. If the voice to be coded has amplitudes concentrating on the latter half of the frame in the voice rising section, etc., the second algebraic sound source coding means using the sound source position candidates having a backward leaning distribution is selected. In other sections, the first algebraic sound source coding means using the sound source position candidates having an equal distribution that can represent the whole in the frame is selected.

The following configuration is also possible: N−2 sound source position tables (where N is three or more) are added, N types of algebraic sound source coding are performed, selection mean 20 selects the one to provide the smallest distance among them and outputs selection information, and switch means 21 uses one of the N sound source position tables based on the selection information to perform algebraic sound source decoding. Various configurations including that of using the table with the sound source positions collected in the first half of the frame shown in FIG. 3B as the first sound source position table.

As in the first embodiment, it is also possible to eliminate adaptive sound source coding means and adaptive sound source decoding means and code only with a drive sound source and a gain.

According to the second embodiment, a plurality of algebraic sound source coding means using sound source position candidates different in distribution lean in a frame are provided and algebraic sound source coding means with the smallest coding distortion is selected, so that voice coding apparatus that can perform coding using a sound source position candidate fitted to an input voice and is good in quality although a low bit rate is applied can be provided, as in the first embodiment.

According to the second embodiment, a plurality of algebraic sound source decoding means using sound source position candidates different in distribution lean in a frame are provided and based on the selection information, one of the algebraic sound source decoding means is used to decode the sound source, so that voice decoding apparatus that can perform decoding using an optimum sound source position candidate selected for an input voice and is good in quality although a low bit rate is applied can be provided, as in the first embodiment.

Since fixed sound source position candidates are used, characteristic improvement can be accomplished while resistance to a code transmission error on a communication channel is maintained. Even to introduce adaptive sound source position candidates into a part, when algebraic sound source coding using the remaining fixed sound source position candidates is selected, the effect of a transmission error is largely forgotten and characteristic improvement can be accomplished while resistance to a code transmission error on a communication channel is maintained to some extent.

Further, at least one of the sound source position candidates is determined to have a distribution leaning to the backward part of the current frame, whereby the algebraic sound source coding means and the algebraic sound source decoding means using the sound source position candidates having the backward leaning distribution are selected in the voice rising part, etc., for executing good coding and decoding. In a frame where good coding and decoding cannot be performed using the sound source position candidates having the backward leaning distribution, different algebraic sound source coding means and algebraic sound source decoding means are selected for executing coding and decoding without extreme degradation, so that voice coding apparatus and voice decoding apparatus which are good in quality although a low bit rate is applied can be provided.

As compared with the configuration in the related art wherein the sound source position candidates are provided equally in a frame, the algebraic sound source coding means using the sound source position candidates distributed leaning to the backward part of a frame can suppress quality degradation in rising, etc., whereby particularly the hearing sense quality is improved.

(Third Embodiment)

Figure 7:
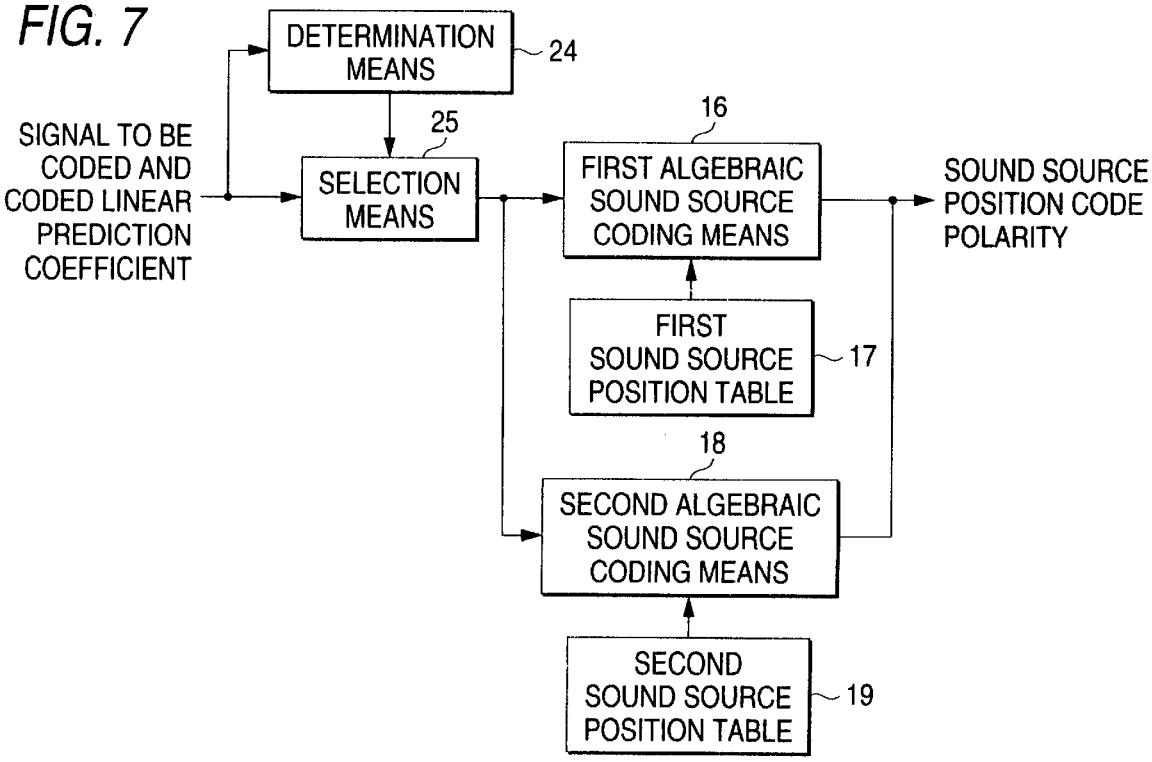
FIG. 7 is a block diagram of drive sound source coding means in a voice coding apparatus according to a third embodiment of the invention.

FIG. 7 shows the configuration of drive sound source coding means 5 in a voice coding apparatus according to a second embodiment of the invention. The general configuration of the voice coding apparatus is similar to that previously described with reference to FIG. 15. In FIG. 7, numeral 16 denotes first algebraic sound source coding means, numeral 17 denotes a first sound source position table, numeral 18 denotes second algebraic sound source coding means, numeral 19 denotes a second sound source position table, numeral 24 denotes determination means, and numeral 25 denotes selection means.

Figures 8, 9:
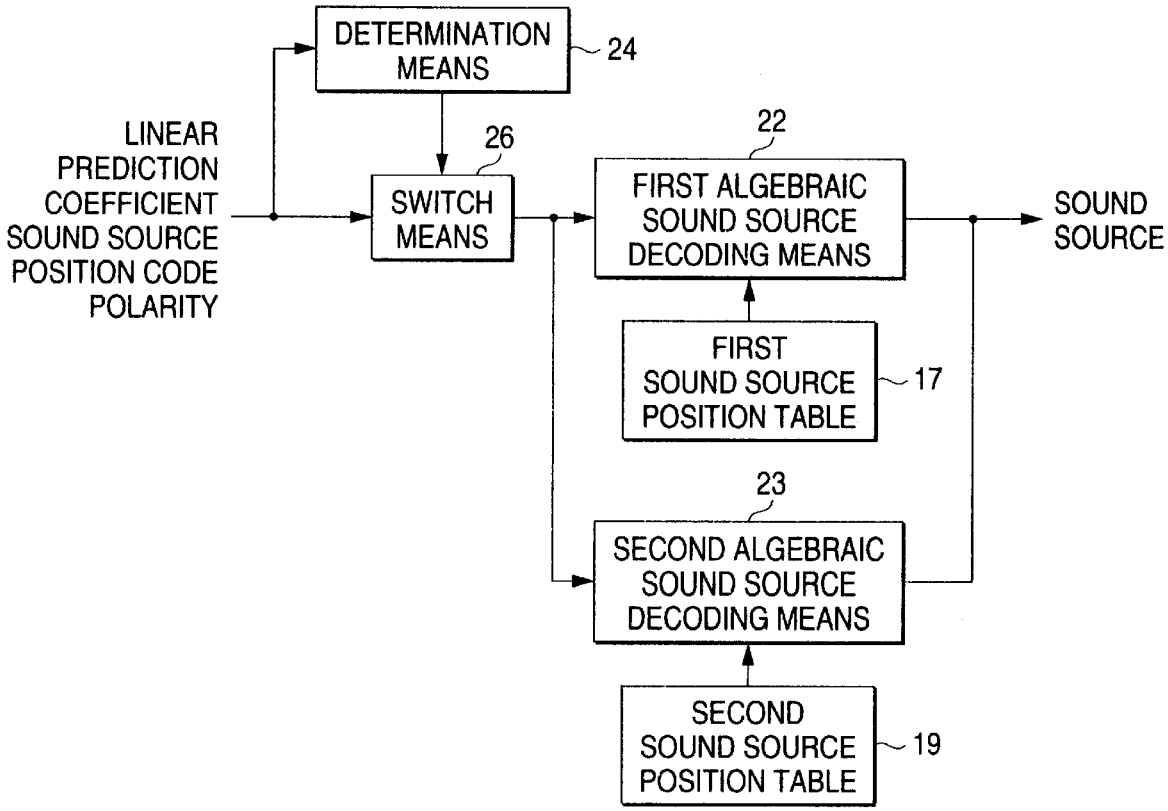
FIG. 8 is a block diagram of drive sound source decoding means in a voice decoding apparatus according to the third embodiment of the invention.
FIG. 9 is a schematic representation of a second sound source position table used in the third embodiment of the invention.

FIG. 8 shows the configuration of drive sound source decoding means 12 in a voice decoding apparatus according to the third embodiment of the invention. The general configuration of the voice decoding apparatus is similar to that previously described with reference to FIG. 16 except that output of linear prediction coefficient decoding means 10 is also supplied to the drive sound source decoding means 12. In FIG. 8, numeral 26 denotes switch means, numeral 22 denotes first algebraic sound source decoding means, and numeral 23 denotes second algebraic sound source decoding means.

The operation will be discussed based on the accompanying drawings.

First, in the voice coding apparatus, a signal to be coded and a coded linear prediction coefficient are input to the determination means 24 and the selection means 25.

The determination means 24 analyzes the coded linear prediction coefficient, determines whether or not the current frame has frictional sound features, and outputs the determination result to the selection means 25. If a frictional sound is involved, often a feature that the spectrum is flat or inclined to a high area and a feature that the prediction gain of the linear prediction coefficient is small are indicated. Then, when the coded linear prediction coefficient is analyzed, if both the features are involved, the current frame is determined to be like a frictional sound.

If the determination result indicates that the current frame does not have the frictional sound features, the selection means 25 outputs the signal to be coded and the coded linear prediction coefficient to the first algebraic sound source coding means 16. If the determination result indicates that the current frame has the frictional sound features, the selection means 25 outputs the signal to be coded and the coded linear prediction coefficient to the second algebraic sound source coding means 18.

The first algebraic sound source coding means 16 sequentially reads sound source position candidates stored in the first sound source position table 17, prepares a tentative composite tone when a pulse is set with an appropriate polarity at each position, calculates the distance to the signal to be coded, and makes a search for the sound source position and the polarity to minimize the distance. Then, the first algebraic sound source coding means 16 outputs the sound source position code representing the sound source position at the time and the polarity.

The second algebraic sound source coding means 18 sequentially reads sound source position candidates stored in the second sound source position table 19, prepares a tentative composite tone when a pulse is set with an appropriate polarity at each position, calculates the distance to the signal to be coded, and makes a search for the sound source position and the polarity to minimize the distance. Then, the first algebraic sound source coding means 16 outputs the sound source position code representing the sound source position at the time and the polarity.

That is, the drive sound source coding means 5 outputs the sound source position code and the polarity output by the first algebraic sound source coding means 16 or the second algebraic sound source coding means 18.

FIG. 9 shows an example of the second sound source position table 19 used when the frame length of sound source coding is 80 points. As the first sound source position table, the same table as shown in FIG. 3A is used. In the second sound source position table 19, the pulse position candidate with sound source number 1 is limited to the frame top. The most of as many information bits as transmission of position information with sound source number 1 becomes unnecessary is made for increasing one sound source.

Using the second sound source position table 19 shown in FIG. 9, the second algebraic sound source coding means 18 always outputs the codes representing five sound source positions containing the top sound source position in a frame and polarities.

In the voice decoding apparatus, the determination means 24 in the drive sound source decoding means 12, which has the same configuration as that in the drive sound source coding means 5, analyzes the linear prediction coefficient output by the linear prediction coefficient decoding means 10, determines whether or not the current frame has frictional sound features, and outputs the determination result to the switch means 26.

When the determination result of the determination means 24, the sound source position code, and the polarity are input, the switch means 26 outputs the sound source position code and the polarity to either the first algebraic sound source decoding means 22 or the second algebraic sound source decoding means 23 according to the determination result. If the determination result indicates that the current frame does not have frictional sound features, the switch means 26 outputs the sound source position code and the polarity to the first algebraic sound source decoding means 22; if the determination result indicates that the current frame has frictional sound features, the switch means 26 outputs the sound source position code and the polarity to the second algebraic sound source decoding means 23.

The first algebraic sound source decoding means 22 reads the sound source position corresponding to the sound source position code from the first sound source position table 17, which is the same as the first sound source position table 17 of the first algebraic sound source coding means 16, applies a pitch filter to a signal with a pulse or a fixed sound source given the polarity placed at the sound source position to provide a sound source, and outputs the sound source. That is, to use the first sound source position table 17 shown in FIG. 3A, a pulse or a fixed sound source is placed at each of the four positions corresponding to the four sound source position codes and the sound source provided by applying the pitch filter is output.

The second algebraic sound source decoding means 23 reads. the sound source position corresponding to the sound source position code from the second sound source position table 19, which is the same as the second sound source position table 19 of the second algebraic sound source coding means 18, applies a pitch filter to a signal with a pulse or a fixed sound source given the polarity placed at the sound source position to provide a sound source, and outputs the sound source. That is, to use the second sound source position table 19 shown in FIG. 7, a pulse or a fixed sound source is placed at each of the five positions containing the frame top and the sound source provided by applying the pitch filter is output.

The sound source output by the first algebraic sound source decoding means 22 or the second algebraic sound source decoding means 23 becomes the final output of the drive sound source decoding means 12.

Figure 10:
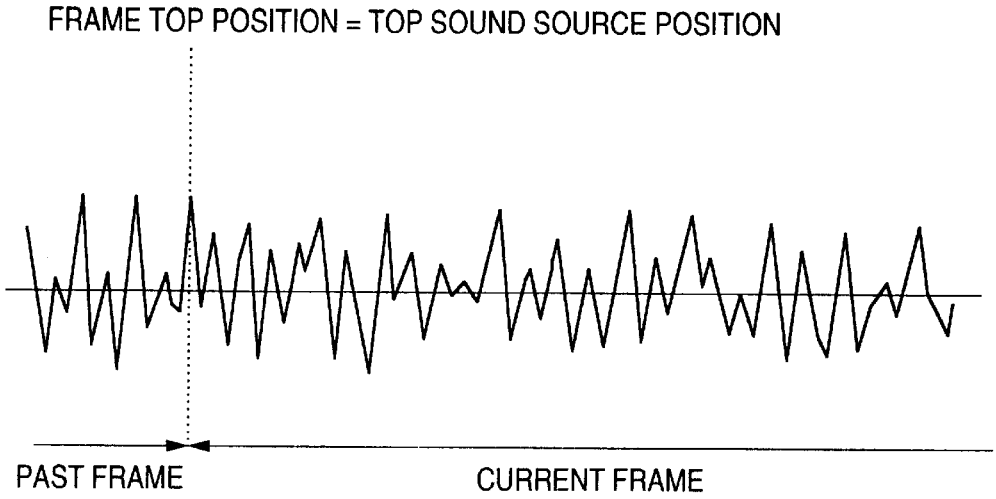
FIG. 10 is a schematic representation of output voice according to the third embodiment of the invention.
Figures 17, 18:
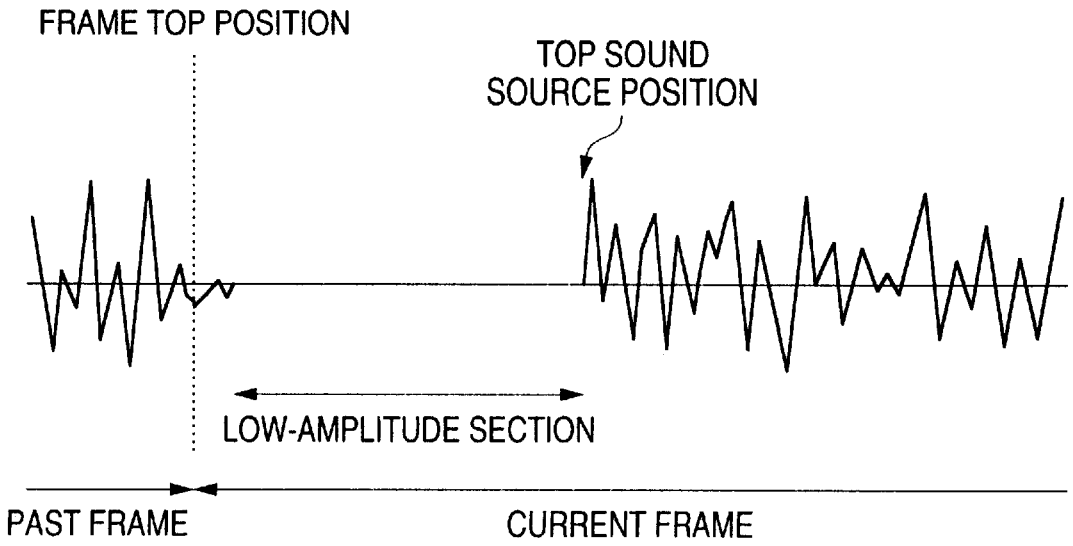
FIG. 17 is a schematic representation of pulse sound sources used in Document 1 in a related art.
FIG. 18 is a schematic representation of output voice involving a discontinuous feel in a related art.

FIG. 10 shows an example of an output voice 15 provided using the sound source output from the drive sound source decoding means 12. In a frame determined to have frictional sound features, the sound source is always placed at the top of the frame, thus a low-amplitude section in the related art as shown in FIG. 18 does not occur.

In the embodiment, the pitch filter is introduced into the drive sound source preparation section; it can be introduced only in the drive sound source decoding means 12 or introduced in neither the drive sound source coding means 5 nor the drive sound source decoding means 12, of course.

The first sound source position table 17 and the second sound source position table 19 can also be connected to the first algebraic sound source coding means 16 through the switch means for eliminating the need for the second algebraic sound source coding means 18. Likewise, the first sound source position table 17 and the second sound source position table 19 can also be connected to the first algebraic sound source decoding means 22 through the switch means 20 for eliminating the need for the second algebraic sound source decoding means 23.

The following configuration is also possible: N−2 sound source position tables (where N is three or more) are added, algebraic sound source coding is selected based on the determination result of the determination means 24 in the drive sound source coding means 5, and one of the N sound source position tables is used based on the determination result of the determination means 24 in the drive sound source decoding means 12 to perform algebraic sound source coding.

Further, as the analysis parameter of the determination means 24, any other code information such as power information than the coded linear prediction coefficient or a combination thereof can also be used. Any other spectrum parameter such as LSP may be used in place of the linear prediction coefficient.

Of course, the determination means 24 can also be set so as to make a determination so as to use the second sound source position table for input which becomes better in quality if a sound source is placed in the vicinity of the top for background noise, etc., for example, other than the frictional sound.

As in the first embodiment, it is also possible to eliminate the adaptive sound source coding means and the adaptive sound source decoding means and code only with a drive sound source and a gain.

According to the third embodiment, a plurality of algebraic sound source coding means for coding a sound source based on the sound source position and the polarity selected from among the sound source position candidates different in distribution lean in a frame are provided, at least one algebraic sound source coding means selects one or more sound source positions from within the range of a small number of samples starting at the frame top, and one of the algebraic sound source coding means is selected, so that voice coding apparatus that can perform coding using a sound source position candidate fitted to an input voice and is good in quality although a low bit rate is applied can be provided.

Particularly, the following problem can be resolved: Since the sound source positions provided as the coding result concentrate on the back of the frame, a low-amplitude section of drive sound source is produced in the first half of the frame, and a discontinuous sense of amplitude is heard in a section of small amplitude of adaptive sound source such as a frictional sound. The problem can be resolved without losing the feature of an algebraic sound source lessening the memory amount and the operation amount.

According to the third embodiment, a plurality of algebraic sound source decoding means using the sound source position candidates different in distribution lean in a frame are provided, at least one algebraic sound source decoding means selects one or more sound source positions from within the range of a small number of samples starting at the frame top, and one of the algebraic sound source decoding means is used to decode the sound source, so that voice decoding apparatus that can perform decoding using an optimum sound source position candidate selected for an input voice and is good in quality although a low bit rate is applied can be provided, as in the first embodiment.

Particularly, the following problem can be resolved: Since the decoded sound source positions concentrate on the back of the frame, a low-amplitude section of drive sound source is produced in the first half of the frame, and a discontinuous sense of amplitude is heard in a section of small amplitude of adaptive sound source such as a frictional sound. The problem can be resolved without losing the feature of an algebraic sound source lessening the memory amount and the operation amount.

The position candidates for one sound source in at least one sound source position candidate used with each algebraic sound source coding means and each algebraic sound source decoding means are limited within the range of a small number of samples from the frame top, whereby the problem of the discontinuous sense can be easily resolved without losing the feature of an algebraic sound source lessening the memory amount and the operation amount.

Further, the algebraic sound source coding means is selected based on a predetermined parameter representing the input voice feature, such as linear prediction coefficient, and the algebraic sound source decoding means is selected based on the predetermined parameter representing the input voice feature, such as linear prediction coefficient, or the selection information input from the algebraic sound source coding means, so that only frames where a discontinuous sound easily occurs such as frictional sound are determined and the problem of the discontinuous sense can be resolved while quality degradation in other frames is minimized.

Output of the voice coding apparatus such as coded linear prediction coefficient previously provided is used as the predetermined parameter, whereby the need for transmitting the selection information is eliminated, so that an increase in the transmission information amount is not incurred and good-quality voice coding apparatus resolving the problem of the discontinuous sense at a low bit rate intact can be provided.

The predetermined sample range is set only at the frame top, whereby occurrence of a low-amplitude section at the frame top can be best suppressed.

(Fourth Embodiment)

Figure 11:
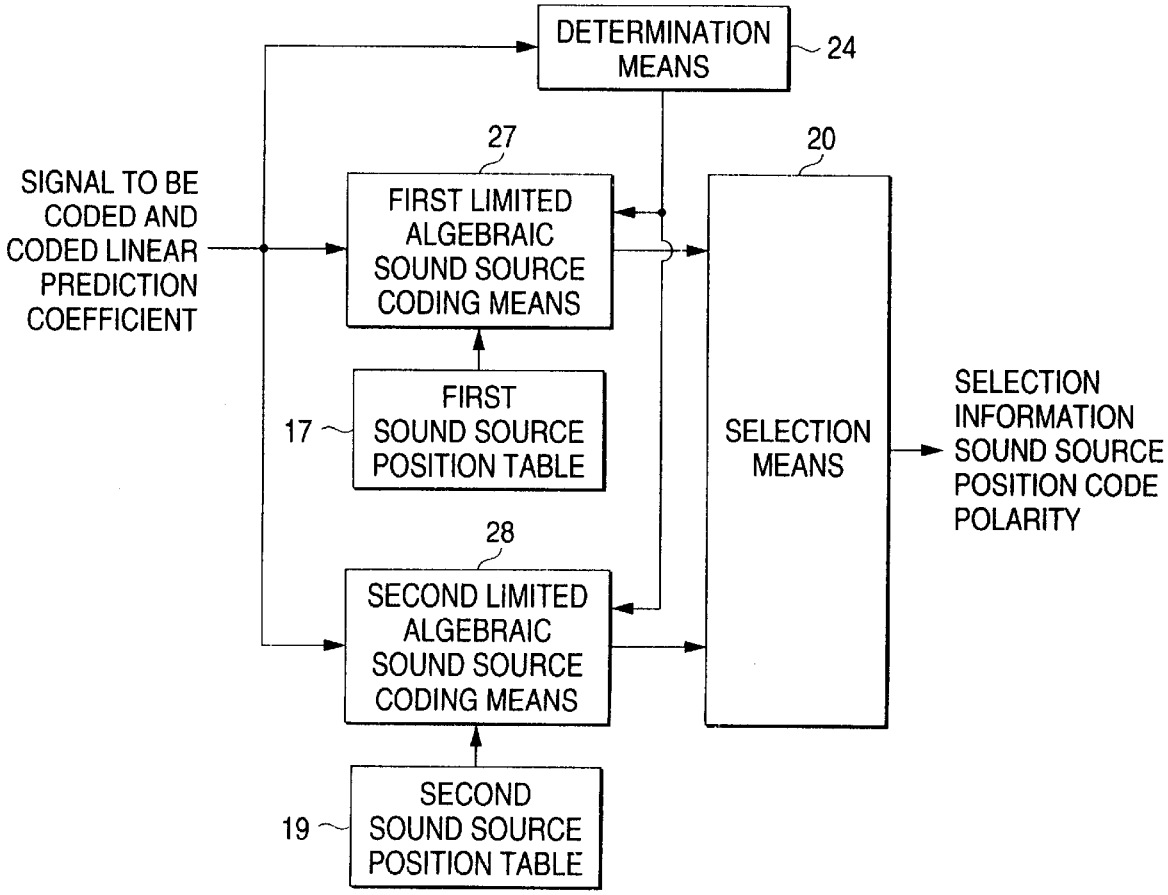
FIG. 11 is a block diagram of drive sound source coding means in a voice coding apparatus according to a fourth embodiment of the invention.

FIG. 11 shows the configuration of drive sound source coding means 5 in a voice coding apparatus according to a fourth embodiment of the invention. The general configuration of the voice coding apparatus is similar to that previously described with reference to FIG. 15. In FIG. 11, numeral 27 denotes first limited algebraic sound source coding means, numeral 17 denotes a first sound source position table, numeral 28 denotes second limited algebraic sound source coding means, numeral 19 denotes a second sound source position table, numeral 24 denotes determination means, and numeral 25 denotes selection means.

The operation will be discussed based on the accompanying drawings.

First, a signal to be coded and a coded linear prediction coefficient are input to the determination means 24, the first limited algebraic sound source coding means 27, and the second limited algebraic sound source coding means 28.

The determination means 24 analyzes the coded linear prediction coefficient, determines whether or not the current frame has frictional sound features, and outputs the determination result to the first limited algebraic sound source coding means 27 and the second limited algebraic sound source coding means 28.

A similar method to that in the third embodiment can be used as the determination method of the determination means. That is, if a frictional sound is involved, often a feature that the spectrum is flat or inclined to a high area and a feature that the prediction gain of the linear prediction coefficient is small are indicated. Then, when the coded linear prediction coefficient is analyzed, if both the features are involved, the current frame is determined to be like a frictional sound.

Further, as the analysis parameter of the determination means 24, any other code information such as power information than the coded linear prediction coefficient or a combination thereof can also be used. Any other spectrum parameter such as LSP may be used in place of the linear prediction coefficient.

If the determination result of the determination means 24 indicates that the current frame does not have the frictional sound features, the first limited algebraic sound source coding means 27 sequentially reads sound source position candidates stored in the first sound source position table 17, prepares a tentative composite tone when a pulse is set with an appropriate polarity at each position, calculates the distance to the signal to be coded, and makes a search for the sound source position and the polarity to minimize the distance. Then, the first limited algebraic sound source coding means 27 outputs the minimum distance, the sound source position code representing the sound source position at the time, and the polarity to the selection means 20.

If the determination result indicates that the current frame has the frictional sound features, the first limited algebraic sound source coding means 27 sequentially reads only those wherein one or more sound source positions are within the range of N samples starting at the frame top from among the sound source position candidate combinations stored in the first sound source position table 17, prepares a tentative composite tone when a pulse is set with an appropriate polarity at each position, calculates the distance to the signal to be coded, and makes a search for the sound source position and the polarity to minimize the distance. Then, the first limited algebraic sound source coding means 27 outputs the minimum distance, the sound source position code representing the sound source position at the time, and the polarity to the selection means 20. The value of N is set to a small value effective for resolving a problem of a discontinuous sound (about several samples).

If the determination result indicates that the current frame does not have the frictional sound features, the second limited algebraic sound source coding means 28 sequentially reads sound source position candidates stored in the second sound source position table 19, prepares a tentative composite tone when a pulse is set with an appropriate polarity at each position, calculates the distance to the signal to be coded, and makes a search for the sound source position and the polarity to minimize the distance. Then, the first limited algebraic sound source coding means 27 outputs the minimum distance, the sound source position code representing the sound source position at the time, and the polarity to the selection means 20.

If the determination result indicates that the current frame has the frictional sound features, the second limited algebraic sound source coding means 28 sequentially reads only those wherein one or more sound source positions are within the range of N samples starting at the frame top from among the sound source position candidate combinations stored in the second sound source position table 19, prepares a tentative composite tone when a pulse is set with an appropriate polarity at each position, calculates the distance to the signal to be coded, and makes a search for the sound source position and the polarity to minimize the distance. Then, the second limited algebraic sound source coding means 28 outputs the minimum distance, the sound source position code representing the sound source position at the time, and the polarity to the selection means 20.

The selection means 20 compares the minimum distance output by the first limited algebraic sound source coding means 27 with the minimum distance output by the second limited algebraic sound source coding means 28, selects the limited algebraic sound source coding means outputting the smaller distance, and outputs the selection information and the sound source position code and the polarity output by the selected limited algebraic sound source coding means. The sound source position code and the polarity become output of the drive sound source coding means 5.

Figure 12:
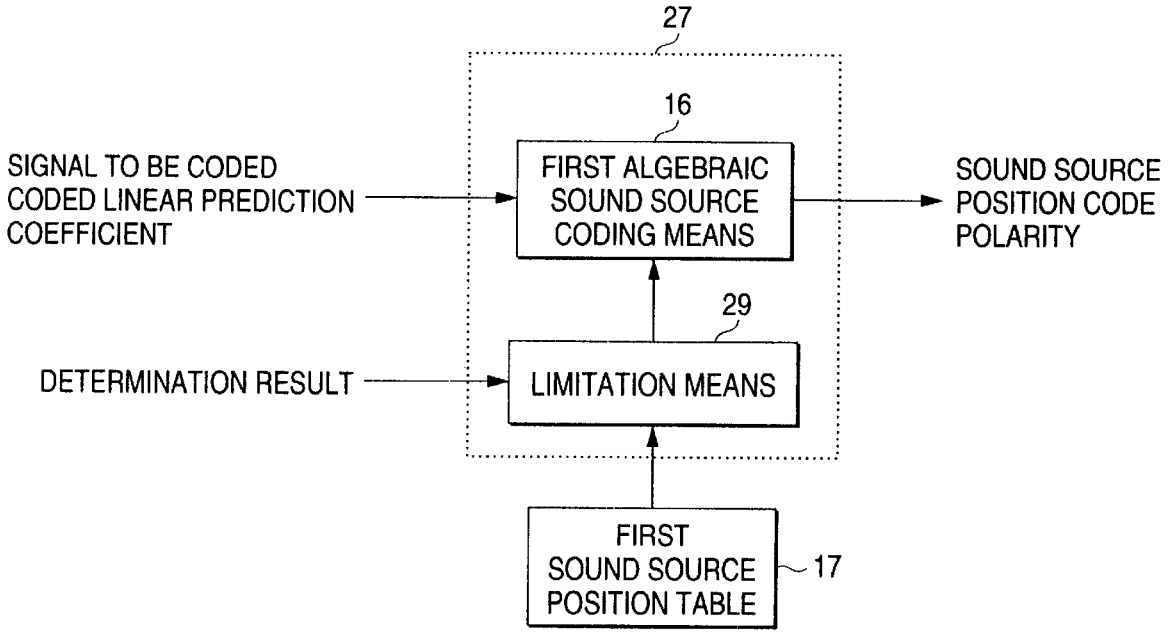
FIG. 12 is a block diagram of first limited algebraic sound source coding means and a first sound source position table.

FIG. 12 shows the detailed configuration of only the first limited algebraic sound source coding means 27 and the first sound source position table 17. In the figure, numeral 16 denotes first algebraic sound source coding means having the same configuration as that in the first embodiment and numeral 29 denotes limitation means.

The signal to be coded and the coded linear prediction coefficient are input to the first algebraic sound source coding means 16. The determination result output by the determination means 24 is input to the limitation means 29.

From the first sound source position table 17, sound source position candidate combinations are output in sequence to the limitation means 29 in the first limited algebraic sound source coding means 27. If the determination result indicates that the current frame has the frictional sound features, the limitation means 29 sequentially outputs only those wherein one or more sound source positions are within the range of N samples starting at the frame top to the first algebraic sound source coding means 16. If the determination result indicates that the current frame does not have the frictional sound features, the limitation means 29 sequentially outputs all input sound source position candidate combinations to the first algebraic sound source coding means 16.

In response to each sound source position candidate combination input from the limitation means 29, the first algebraic sound source coding means 16 prepares a tentative composite tone when a pulse is set with an appropriate polarity at each position, calculates the distance to the signal to be coded, and makes a search for the sound source position and the polarity to minimize the distance. Then, the first algebraic sound source coding means 16 outputs the minimum distance, the sound source position code representing the sound source position at the time, and the polarity to the selection means 20.

The second limited algebraic sound source coding means 28 has a similar configuration.

As decoding processing corresponding to the drive sound source coding means 5, the same decoding processing as the drive sound source decoding means 12 previously described with reference to FIG. 2 in the first embodiment can be used.

Figure 13:
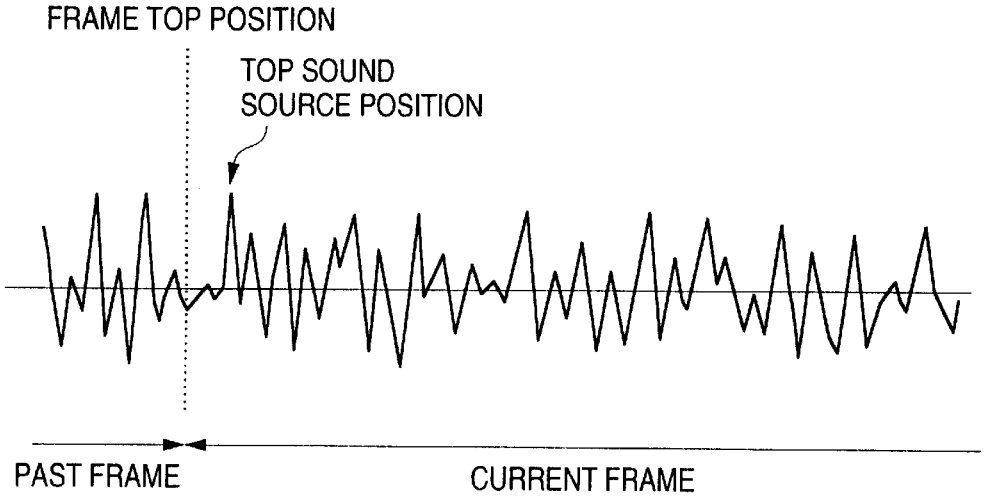
FIG. 13 is a schematic representation of output voice according to a fourth embodiment of the invention.

FIG. 13 shows an example of an output voice 15 finally provided when the drive sound source coding means 5 is used. In a frame determined to have frictional sound features, the sound source is always placed within N samples from the top of the frame, thus a low-amplitude section in the related art as shown in FIG. 18 does not largely occur.

The first sound source position table 17 and the second sound source position table 19 can also be connected to the first limited algebraic sound source coding means 26 through a changeover switch for eliminating the need for the second limited algebraic sound source coding means 27.

The following configuration is also possible: N−2 limited sound source position tables (where N is three or more) are added, N types of algebraic sound source coding are performed, selection mean 20 selects the one to provide the smallest distance among them and outputs selection information, and switch means 21 uses one of the N sound source position tables based on the selection information to perform algebraic sound source decoding.

As in the first embodiment, it is also possible to eliminate adaptive sound source coding means and adaptive sound source decoding means and code only with a drive sound source and a gain.

As in the first embodiment, it is also possible to eliminate adaptive sound source coding means and adaptive sound source decoding means and code only with a drive sound source and a gain.

If one algebraic sound source search means is provided as in the configuration in the related art, it can also be used as the limited algebraic sound source coding means described above, of course.

According to the fourth embodiment, only if a predetermined parameter representing the input voice feature satisfies a predetermined condition, the sound source position combinations are limited for making a search. Thus, the following problem can be resolved: Drive sound source amplitude variation becomes large because the sound source positions provided as the coding result concentrate on a part of the frame or for any other reason, and a discontinuous sense of amplitude is heard in a section of small amplitude of adaptive sound source such as a frictional sound. The problem can be resolved without losing the feature of an algebraic sound source lessening the memory amount and the operation amount.

Particularly, one or more sound source positions are selected from within the range of a small number of samples starting at the frame top as the limitation on the sound source position combinations. Thus, the following problem can be resolved: Since the sound source positions provided as the coding result concentrate on the back of the frame, a low-amplitude section of drive sound source is produced in the first half of the frame, and a discontinuous sense of amplitude is heard in a section of small amplitude of adaptive sound source such as a frictional sound. The problem can be resolved without losing the feature of an algebraic sound source lessening the memory amount and the operation amount.

Further, the algebraic sound source coding means is selected based on a predetermined parameter representing the input voice feature, such as linear prediction coefficient, and the algebraic sound source decoding means is selected based on the predetermined parameter representing the input voice feature, such as linear prediction coefficient, or the selection information input from the algebraic sound source coding means, so that only frames where a discontinuous sound easily occurs such as frictional sound are determined and the problem of the discontinuous sense can be resolved while quality degradation in other frames is minimized.

Output of the voice coding apparatus such as coded linear prediction coefficient previously provided is used as the predetermined parameter, whereby the need for transmitting the selection information is eliminated, so that an increase in the transmission information amount is not incurred and good-quality voice coding apparatus resolving the problem of the discontinuous sense at a low bit rate intact can be provided.

(Fifth Embodiment)

In the fourth embodiment, the limitation means 29 outputs only those wherein one or more sound source positions are within the range of N samples starting at the frame top. However, it is also possible to equally divide a frame into as many divisions as the number of pulses and limit combinations only to those wherein one pulse is always contained in each division. A sound source position table used in this case needs to be a table having a uniform distribution in a frame as in FIG. 3A rather than a table having a leaning distribution as in FIG. 3B or 5B.

Figure 14:
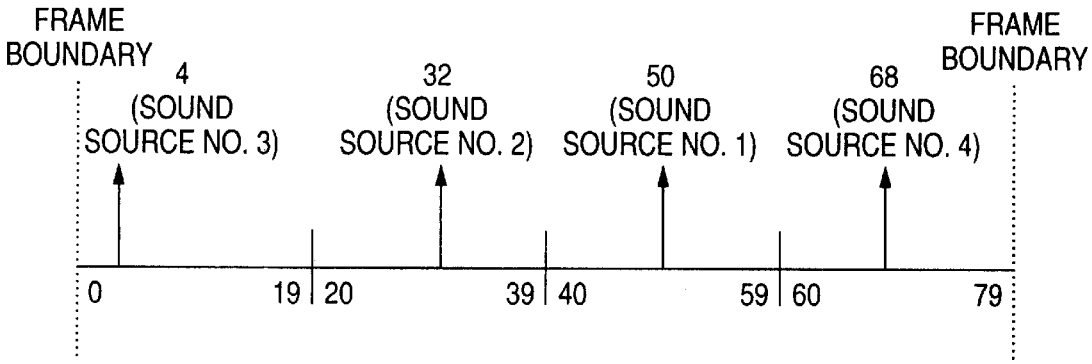
FIG. 14 is a schematic representation of limitation means according to a fifth embodiment of the invention.

FIG. 14 is a schematic representation to describe an example. The same table as in FIG. 3A is used as the sound source position table. The whole frame includes positions 0 to 79. If it is equally divided into as many divisions as the number of pulses, 4, the frame is divided into positions 0 to 19, positions 20 to 39, positions 40 to 59, and positions 60 to 79 as shown in FIG. 14. If the sound source position table is referenced and position 50 is selected from among the position candidates with sound source number 1, position 32 is selected from among the position candidates with sound source number 2, position 4 is selected from among the position candidates with sound source number 3, and position 68 is selected from among the position candidates with sound source number 4, the four sound source positions as shown in FIG. 14 are selected; one sound source position is placed in each of the four divisions. A search is made for one from among the combinations wherein one pulse is always contained in each division.

According to the fifth embodiment, only if a predetermined parameter representing the input voice feature satisfies a predetermined condition, the sound source position combinations are limited for making a search. Thus, the following problem can be resolved: Drive sound source amplitude variation becomes large because the sound source positions provided as the coding result concentrate on a part of the frame or for any other reason, and a discontinuous sense of amplitude is heard in a section of small amplitude of adaptive sound source such as a frictional sound. The problem can be resolved without losing the feature of an algebraic sound source lessening the memory amount and the operation amount.

Particularly, the sound sources are scattered in a frame by limiting the sound source position combinations. Thus, the following problem can be resolved in the whole frame: A discontinuous sense of amplitude is heard in a section of small amplitude of adaptive sound source such as a frictional sound. The problem can be resolved without losing the feature of an algebraic sound source lessening the memory amount and the operation amount.

According to the voice coding apparatus of the invention, a plurality of algebraic sound source coding means using sound source position candidates different in distribution lean in a frame are provided and algebraic sound source coding means with the smallest coding distortion is selected, so that voice coding apparatus that can perform coding using a sound source position candidate fitted to an input voice and is good in quality although a low bit rate is applied can be provided.

Since fixed sound source position candidates are used, characteristic improvement can be accomplished while resistance to a code transmission error on a communication channel is maintained. Even to introduce adaptive sound source position candidates into a part, when algebraic sound source coding using the remaining fixed sound source position candidates is selected, the effect of a transmission error is largely forgotten and characteristic improvement can be accomplished while resistance to a code transmission error on a communication channel is maintained to some extent.

According to the voice coding apparatus or the voice decoding apparatus of the invention, at least one of the sound source position candidates is determined to have a distribution leaning to the forward part of the current frame, whereby the algebraic sound source coding means and the algebraic sound source decoding means using the sound source position candidates having the forward leaning distribution are selected in a comparatively steady vowel part, etc., for executing good coding and decoding. In a frame where good coding and decoding cannot be performed using the sound source position candidates having the forward leaning distribution, different algebraic sound source coding means and algebraic sound source decoding means are selected for executing coding and decoding without extreme degradation, so that voice coding apparatus and voice decoding apparatus which are good in quality although a low bit rate is applied can be provided.

As compared with the configuration in the related art wherein the sound source position candidates are provided equally in a frame, the algebraic sound source coding means using the sound source position candidates distributed leaning to the forward part of a frame accomplishes average characteristic improvement. Also as compared with the configuration in the related art wherein the sound source position candidates are concentrated on the one-pitch period section, another algebraic sound source coding means can suppress quality degradation in rising, etc., whereby particularly the hearing sense quality is improved.

According to the voice coding apparatus or the voice decoding apparatus of the invention, at least one of the sound source position candidates is determined to have a distribution leaning to the backward part of the current frame, whereby the algebraic sound source coding means and the algebraic sound source decoding means using the sound source position candidates having the backward leaning distribution are selected in the voice rising part, etc., for executing good coding and decoding. In a frame where good coding and decoding cannot be performed using the sound source position candidates having the backward leaning distribution, different algebraic sound source coding means and algebraic sound source decoding means are selected for executing coding and decoding without extreme degradation, so that voice coding apparatus and voice decoding apparatus which are good in quality although a low bit rate is applied can be provided.

As compared with the configuration in the related art wherein the sound source position candidates are provided equally in a frame, the algebraic sound source coding means using the sound source position candidates distributed leaning to the backward part of a frame can suppress quality degradation in rising, etc., whereby particularly the hearing sense quality is improved.

According to the voice coding apparatus of the invention, a plurality of algebraic sound source coding means for coding a sound source based on the sound source position and the polarity selected from among the sound source position candidates different in distribution lean in a frame are provided, at least one algebraic sound source coding means selects one or more sound source positions from within the range of a small number of samples starting at the frame top, and one of the algebraic sound source coding means is selected, so that voice coding apparatus that can perform coding using a sound source position candidate fitted to an input voice and is good in quality although a low bit rate is applied can be provided.

According to the voice coding apparatus of the invention, the position candidates for one sound source in at least one sound source position candidate used with each algebraic sound source coding means are limited within the range of a small number of samples from the frame top, whereby the problem of the discontinuous sense can be easily resolved without losing the feature of an algebraic sound source lessening the memory amount and the operation amount.

According to the voice coding apparatus and the voice decoding apparatus of the invention, the algebraic sound source coding means is selected based on the spectrum envelope information representing the input voice feature, such as linear prediction coefficient, and the algebraic sound source decoding means is selected based on the spectrum envelope information representing the input voice feature, such as linear prediction coefficient, or the selection information input from the algebraic sound source coding means, so that only frames where a discontinuous sound easily occurs such as frictional sound are determined and the problem of the discontinuous sense can be resolved while quality degradation in other frames is minimized.

According to the voice coding apparatus of the invention, output of the voice coding apparatus such as coded linear prediction coefficient previously provided is used as the spectrum envelope information, whereby the need for transmitting the selection information is eliminated, so that an increase in the transmission information amount is not incurred and good-quality voice coding apparatus resolving the problem of the discontinuous sense at a low bit rate intact can be provided.

According to the voice coding apparatus of the invention, only if a predetermined parameter representing the input voice feature satisfies a predetermined condition, the sound source position combinations are limited for making a search. Thus, the following problem can be resolved: Drive sound source amplitude variation becomes large because the sound source positions provided as the coding result concentrate on a part of the frame or for any other reason, and a discontinuous sense of amplitude is heard in a section of small amplitude of adaptive sound source such as a frictional sound. The problem can be resolved without losing the feature of an algebraic sound source lessening the memory amount and the operation amount.

According to the voice coding apparatus of the invention, one or more sound source positions are selected from within the range of a small number of samples starting at the frame top as the limitation on the sound source position combinations. Thus, the following problem can be resolved: Since the sound source positions provided as the coding result concentrate on the back of the frame, a low-amplitude section of drive sound source is produced in the first half of the frame, and a discontinuous sense of amplitude is heard in a section of small amplitude of adaptive sound source such as a frictional sound. The problem can be resolved without losing the feature of an algebraic sound source lessening the memory amount and the operation amount.

According to the voice coding apparatus of the invention, the sound sources are scattered in a frame by limiting the sound source position combinations. Thus, the following problem can be resolved in the whole frame: A discontinuous sense of amplitude is heard in a section of small amplitude of adaptive sound source such as a frictional sound. The problem can be resolved without losing the feature of an algebraic sound source lessening the memory amount and the operation amount.

According to the voice coding apparatus of the invention, the predetermined sample range is set only at the frame top, whereby occurrence of a low-amplitude section at the frame top can be best suppressed.

According to the voice decoding apparatus of the invention, a plurality of algebraic sound source decoding means using sound source position candidates different in distribution lean in a frame are provided and one of the means is used based on the selection information to decode the sound source, so that voice decoding apparatus that can perform decoding using an optimum sound source position candidate selected for an input voice and is good in quality although a low bit rate is applied can be provided.

Since fixed sound source position candidates are used, characteristic improvement can be accomplished while resistance to a code transmission error on a communication channel is maintained. Even to introduce adaptive sound source position candidates into a part, when algebraic sound source coding using the remaining fixed sound source position candidates is selected, the effect of a transmission error is largely forgotten and characteristic improvement can be accomplished while resistance to a code transmission error on a communication channel is maintained to some extent.

According to the voice decoding apparatus of the invention, a plurality of algebraic sound source decoding means using the sound source position candidates different in distribution lean in a frame are provided, at least one algebraic sound source decoding means selects one or more sound source positions from within the range of a small number of samples starting at the frame top, and one of the algebraic sound source decoding means is used to decode the sound source, so that voice decoding apparatus that can perform decoding using an optimum sound source position candidate selected for an input voice and is good in quality although a low bit rate is applied can be provided, as in the first embodiment.

What is claimed is:

1. A voice coding apparatus comprising:

drive sound source coding means, gain coding means, and spectrum envelope information coding means, said voice coding apparatus separating an input voice into spectrum envelope information and a sound source to code the spectrum envelope information and the sound source for each predetermined-length section called a frame, wherein said spectrum envelope information coding means codes the spectrum envelope information of the input voice, said drive sound source coding means comprises;

a plurality of algebraic sound source coding means having sound source position tables different in distribution lean of sound source position candidates in a frame, each algebraic sound source coding means for referencing the spectrum envelope information and coding the sound source of the input voice based on a drive sound source position selected from among the sound source position candidates in the sound source position table and a polarity, and selection means for selecting said algebraic sound source coding means with the smallest coding distortion from among said plurality of algebraic sound source coding means, and outputting selection information, code representing said drive sound source position output by said selected algebraic sound source coding means and polarity, and said gain coding means selects gain code based on said drive sound source and the spectrum envelope information.

2. The voice coding apparatus as claimed in claim 1, wherein at least one of said plurality of algebraic sound source coding means comprises:

the sound source position table having the sound source position candidates distributed leaning to the forward part of the current frame.

3. The voice coding apparatus as claimed in claim 1, wherein at least one of said plurality of algebraic sound source coding means comprises:

the sound source position table having the sound source position candidates distributed leaning to the backward part of the current frame.

4. A voice coding apparatus comprising:

drive sound source coding means, gain coding means, and spectrum envelope information coding means, said voice coding apparatus separating an input voice into spectrum envelope information and a sound source to code the spectrum envelope information and the sound source for each predetermined-length section called a frame, wherein said spectrum envelope information coding means codes the spectrum envelope information of the input voice, said drive sound source coding means comprises:

a plurality of algebraic sound source coding means for coding said sound source of the input voice based on a sound source position selected from among sound source position candidates and a polarity, and selection means for selecting one from among said plurality of algebraic sound source coding means, and outputting selection information, code representing the drive sound source position output by said selected algebraic sound source coding means and a polarity, wherein at least one of said plurality of algebraic sound source coding means selects one or more sound source positions from within the range of a small number of samples starting at the. frame top, and said gain coding means selects gain code based on said drive sound source and the spectrum envelope information.

5. A voice coding apparatus comprising:

drive sound source coding means, gain coding means, and spectrum envelope information coding means, said voice coding apparatus separating an input voice into spectrum envelope information and a sound source to code the spectrum envelope information and the sound source for each predetermined-length section called a frame, wherein said spectrum envelope information coding means codes the spectrum envelope information of the input voice, said drive sound source coding means comprises;

a plurality of algebraic sound source coding means for coding said sound source of the input voice based on a sound source position selected from among sound source position candidates and a polarity, and selection means for selecting one from among said plurality of algebraic sound source coding means, and outputting selection information, code representing the drive sound source position output by said selected algebraic sound source coding means and polarity, wherein said plurality of algebraic sound source coding means differ in sound source position candidates, and the position candidates for one sound source in at least one sound source position candidate are limited within the range of a small number of samples starting at the frame top, and said gain coding means selects gain code based on said drive sound source and the spectrum envelope information.

6. The voice coding apparatus as claimed in claim 4, wherein said selection means selects said algebraic sound source coding means based on a predetermined parameter representing an input voice feature.

7. The voice coding apparatus as claimed in claim 5, wherein said selection means selects said algebraic sound source coding means based on a predetermined parameter representing an input voice feature.

8. A voice coding apparatus comprising:

drive sound source coding means, gain coding means, and spectrum envelope information coding means, said voice coding apparatus separating an input voice into spectrum envelope information and a sound source to code the spectrum envelope information and the sound source for each predetermined-length section called a frame, wherein said spectrum envelope information coding means codes the spectrum envelope information of the input voice, said drive sound source coding means is algebraic sound source coding means for coding said drive sound source based on a sound source position selected from among sound source position candidates and a polarity, and makes a search with a limitation imposed on sound source position combinations only if a predetermined parameter representing an input voice feature satisfies a predetermined condition, and said gain coding means selects gain code based on said drive sound source and the spectrum envelope information.

9. The voice coding apparatus as claimed in claim 8, wherein the limitation imposed on the sound source position combinations is that one or more sound source positions exist in the range of a small number of samples starting at the frame top.

10. The voice coding apparatus as claimed in claim 8, wherein the limitation imposed on the sound source position combinations is that when a frame is equally divided into as any divisions as the number of pulses, one pulse is contained in each division.

11. A voice decoding apparatus comprising:

drive sound source decoding means, gain decoding means, spectrum envelope information decoding means, and a combining filter, said voice decoding apparatus decoding voice code separated into spectrum envelope information and a sound source for each predetermined-length section called a frame, wherein said spectrum envelope information decoding means decodes the spectrum envelope information from the voice code, and sets a coefficient of said combining filter, said drive sound source decoding means comprises a plurality of algebraic sound source decoding means having sound source position tables different in distribution lean of sound source position candidates in a frame, each algebraic sound source coding means for selecting a sound source position among sound source position candidates based on code representing a sound source position in the voice code and decoding said sound source using the sound source position and a polarity, and switch means for outputting the code representing the sound source position in the voice code and the polarity to one of said plurality of algebraic sound source decoding means, said gain decoding means outputs a gain vector corresponding to gain code and multiplies the sound source by the gain vector, and said combining filter uses the coefficient set by said spectrum envelope information decoding means to prepare an output voice from said sound source multiplied by the gain vector.

12. The voice decoding apparatus as claimed in claim 11, wherein at least one of the plurality of sound source position candidates that said plurality of algebraic sound source decoding means have is distributed leaning to the forward part of the current frame.

13. The voice decoding apparatus as claimed in claim 11, wherein at least one of the plurality of sound source position candidates that said plurality of algebraic sound source decoding means have is distributed leaning to the backward part of the current frame.

14. A voice decoding apparatus comprising:

drive sound source decoding means, gain decoding means, spectrum envelope information decoding means, and a combining filter, said voice decoding apparatus decoding voice code separated into spectrum envelope information and a sound source for each predetermined-length section called a frame, wherein said spectrum envelope information decoding means decodes the spectrum envelope information from the voice code, and sets a coefficient of said combining filter, said drive sound source decoding means comprises;

a plurality of algebraic sound source decoding means each for selecting a sound source position among sound source position candidates based on code representing a sound source position in the voice code and decoding the sound source using the sound source position and a polarity, and switch means for outputting the code representing the sound source position in the voice code and the polarity to one of the plurality of algebraic sound source decoding means, wherein said plurality of algebraic sound source decoding means differ in sound source position candidates and the position candidates for one sound source in at least one sound source position candidate are limited within a predetermined range of a small number of samples starting at the frame top, said gain decoding means outputs a gain vector corresponding to gain code and multiplies said sound source by the gain vector, and said combining filter uses the coefficient set by said spectrum envelope information decoding means to prepare an output voice from said sound source multiplied by the gain vector.

15. The voice decoding apparatus as claimed in claim 11, wherein received voice code contains selection information, and said switch means outputs the code representing the sound source position in the voice code and the polarity to one of said plurality of algebraic sound source decoding means based on the selection information.

16. The voice decoding apparatus as claimed in claim 14, wherein received voice code contains selection information, and said switch means outputs the code representing the sound source position in the voice code and the polarity to one of said plurality of algebraic sound source decoding means based on the selection information.

17. The voice decoding apparatus as claimed in claim 11, wherein said switch means finds selection information based on received voice code or the decoding result, and outputs the code representing the sound source position in the voice code and the polarity to one of said plurality of algebraic sound source decoding means based on the selection information.

18. The voice decoding apparatus as claimed in claim 14, wherein said switch means finds selection information based on received voice code or the decoding result, and outputs the code representing the sound source position in the voice code and the polarity to one of said plurality of algebraic sound source decoding means based on the selection information.

* * * * *